US007949269B2

(12) United States Patent
Takeuchi

(10) Patent No.: US 7,949,269 B2
(45) Date of Patent: May 24, 2011

(54) IMAGE FORMING APPARATUS

(75) Inventor: Yasushi Takeuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 464 days.

(21) Appl. No.: 12/167,999

(22) Filed: Jul. 3, 2008

(65) Prior Publication Data

US 2009/0010668 A1 Jan. 8, 2009

(30) Foreign Application Priority Data

Jul. 4, 2007 (JP) ..... 2007-175971

(51) Int. Cl.
*G03G 15/00* (2006.01)
*G03G 15/16* (2006.01)

(52) U.S. Cl. ..... 399/46; 399/49; 399/66

(58) Field of Classification Search ..... 399/46, 399/49, 66

See application file for complete search history.

(56) References Cited

U.S. PATENT DOCUMENTS

| | | | | |
|---|---|---|---|---|
| 5,963,756 | A * | 10/1999 | Sakai et al. | 399/39 |
| 2005/0019048 | A1 * | 1/2005 | Kato | 399/49 |
| 2005/0175365 | A1 * | 8/2005 | Gomi | 399/49 |
| 2006/0251437 | A1 * | 11/2006 | Donaldson | 399/49 |

FOREIGN PATENT DOCUMENTS

| | | | | |
|---|---|---|---|---|
| JP | 6-149057 | A | | 5/1994 |
| JP | 2001-318539 | A | | 11/2001 |
| JP | 2005-128180 | A | | 5/2005 |
| JP | 2006053385 | A | * | 2/2006 |
| JP | 2007-078937 | A | | 3/2007 |
| JP | 2007-079069 | A | | 3/2007 |
| JP | 2009014961 | A | * | 1/2009 |

* cited by examiner

*Primary Examiner* — David M Gray
*Assistant Examiner* — Francis Gray
(74) *Attorney, Agent, or Firm* — Canon U.S.A. Inc., I.P. Division

(57) ABSTRACT

An image forming apparatus includes a black image forming unit that can be used in a black monochrome mode to form supply toner images corresponding to color patches and cause the supply toner images to be carried by an intermediate transfer belt. During the black monochrome mode, a fur brush comes into contact with the supply toner images, so that discharge products are removed from the fur brush. Thus, when the black monochrome mode ends and a full-color mode is returned, the color patches transferred to a secondary transfer roller can be sufficiently removed by single passage and no backside contamination of a recording material occurs.

19 Claims, 18 Drawing Sheets

FULL-COLOR MODE

BLACK MONOCHROME MODE

IMAGE FORMING APPARATUS

BACKGROUND OF THE INVENTION

1. Field of the Invention

The present invention relates to image forming apparatuses, such as printers, copiers, facsimiles, and multifunction peripherals, and particularly to an image forming apparatus that carries control toner images of a plurality of colors.

2. Description of the Related Art

In recent years, image forming apparatuses using an electrophotographic image forming process have been required to be equipped with technology that allows production of higher-quality color images at higher speeds. To achieve this, maintaining color stability, uniformity of color density, and the like is a challenge to be addressed. There is a widely-used technique in which control toner images for control purposes are formed in a non-image region. In this technique, the densities and positions of the control toner images are detected and given as feedback for adjusting conditions of the image forming process and the like, and thus, image stability is maintained. There are some examples of configurations for forming such control toner images. Japanese Patent Laid-Open No. 6-149057 discloses an image forming apparatus that forms control toner images on respective photoconductive drums. Japanese Patent Laid-Open No. 2001-318539 discloses an image forming apparatus that forms color patches on a belt.

Additionally, Japanese Patent Laid-Open No. 2007-079069 discloses a configuration for improved image stability during continuous image formation. In this configuration, during continuous image formation on a plurality of recording materials, control toner images are formed on a belt member in each inter-sheet gap (non-image forming region) between adjacent recording materials. During this image formation, when toner of the control toner images adheres to a transfer member that comes into contact with the belt member, the transfer member becomes contaminated with the toner. To remove the contamination from the transfer member, a cleaning unit is provided. Japanese Patent Laid-Open No. 2007-079069 further discloses a configuration in which, in each inter-sheet gap, control toner images of a plurality of colors are formed at different positions in the axial direction of the transfer member and thus, adjustment of a plurality of image forming units can be made in a short time.

As described in Japanese Patent Laid-Open No. 2007-079069 and Japanese Patent Laid-Open No. 2007-78937, in an image forming apparatus that forms control toner images, toner of control toner images not transferred to recording materials adheres to the transfer member. Then, when the contaminated transfer member comes into contact with the backside of a recording material, backside contamination of the recording material occurs. To prevent this, it is necessary to attach a cleaning device to the transfer member.

Specifically, an electrostatic cleaning device is attached to the transfer member. The electrostatic cleaning device brings a voltage-applied conductive brush member into contact with the transfer member so as to electrostatically attract and collect toner from the transfer member. Here, even when images are continuously output at short intervals between recording materials, it is possible to remove toner from the transfer member.

Japanese Patent Laid-Open No. 2005-128180 discloses an image forming apparatus in which image forming units for yellow, magenta, cyan, and black are arranged along an intermediate transfer belt. Here, it is possible to execute switching between a full-color mode and a black monochrome mode.

When the black monochrome mode is set, the image forming units for yellow, magenta, and cyan are separated from the intermediate transfer belt so that unnecessary wear and power consumption can be prevented.

In a conventional image forming apparatus that forms control toner images of a plurality of colors at different positions in the axial direction of a transfer member, when an image forming mode in which image formation is performed without use of some image forming units is executed, the image forming units that are not used do not form control toner images.

In this image forming apparatus, when this image forming mode continues for a long time (e.g., 5 minutes or more) and then, the image forming units that have not been used (for cyan, magenta, and yellow for example) form control toner images, the following problem can occur. That is, the backside of a recording material may be contaminated in a region corresponding to positions on the transfer member where control toner images are formed, in the rotational axis direction of the transfer member, by the image forming units (for cyan, magenta, and yellow) that have not been used.

This backside contamination of the recording material can be solved by replacing a conductive brush member of an electrostatic cleaning device with a new one. An analysis of the replaced conductive brush member confirmed that a capability of the conductive brush member to remove toner from the surface of the transfer member was degraded in a portion in which the control toner images formed by the image forming units that had not been used adhered.

Moreover, the analysis confirmed that, in the conductive brush member, a portion that regularly collected, from the surface of the transfer member, control toner images formed by the image forming unit that had been used had a higher capability to remove toner than that of the remaining portion of the conductive brush member.

SUMMARY OF THE INVENTION

The present invention provides consistent cleaning performance of a brush member in the axial direction of a transfer member.

Specifically, the present invention provides a image forming apparatus that includes a belt member, a first image forming unit and a second image forming unit that are configured to form toner images on the belt member, a transfer member that is rotatable and is configured to come into contact with the belt member to transfer toner images from the belt member onto a recording material, a brush member configured to come into contact with the transfer member to remove toner from the transfer member, and a controller configured to control image forming conditions of at least one of the first and second image forming units. The controller has a first image forming mode wherein the first image forming unit and the second image forming unit form respective toner images on the belt member, the first image forming unit is allowed to transfer a control toner image to a first region of the belt member, and the second image forming unit is allowed to transfer another control toner image to a second region of the belt member, the first region displaced from the second region in a rotational axis direction of the transfer member. The controller has a second image forming mode wherein only the second image forming unit forms toner images on the belt member, and responsive to the second image forming unit forming a control toner image, toner images are allowed to be disposed on both the first and second regions of the belt member, and one of the toner images is the control toner image.

Further features of the present invention will become apparent from the following description of exemplary embodiments with reference to the attached drawings.

DESCRIPTION OF THE EMBODIMENTS

Hereinafter, exemplary embodiments of the present invention are described in detail with reference to the drawings.

The exemplary embodiments disclose a major part involved in formation and transfer of toner images. The present invention can be implemented in various applications, such as a printer, a copier, a facsimile, and a multifunction peripheral, produced by adding supporting devices, equipment, and housing to the major part. Conventional supporting devices, equipment, and housing can be used, for example.

First Exemplary Embodiment

Figure 1A:
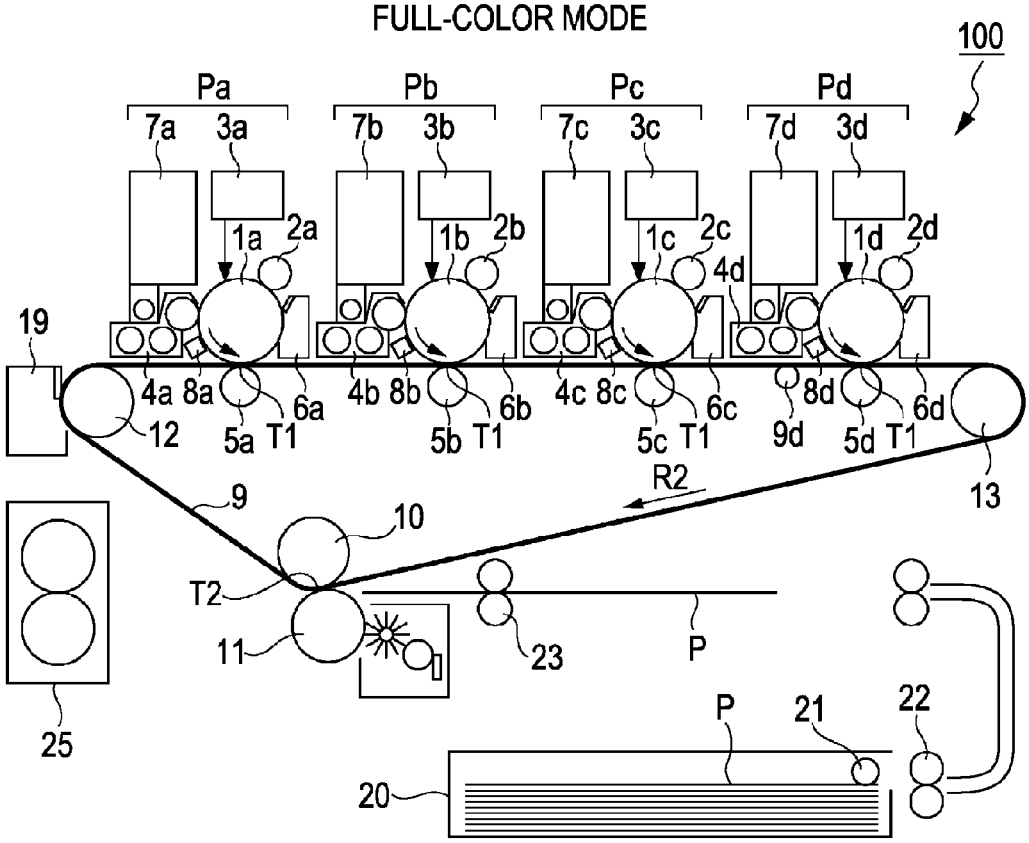
FIG. 1A and FIG. 1B each illustrate a configuration of an image forming apparatus according to a first exemplary embodiment of the present invention.
Figure 1B:
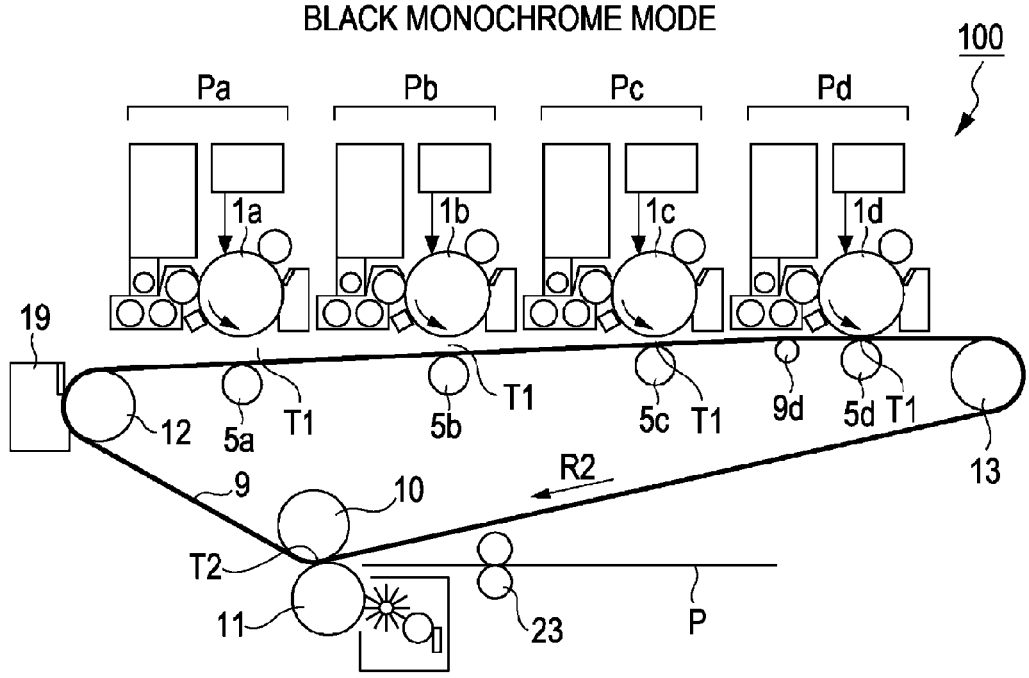
Figure 2:
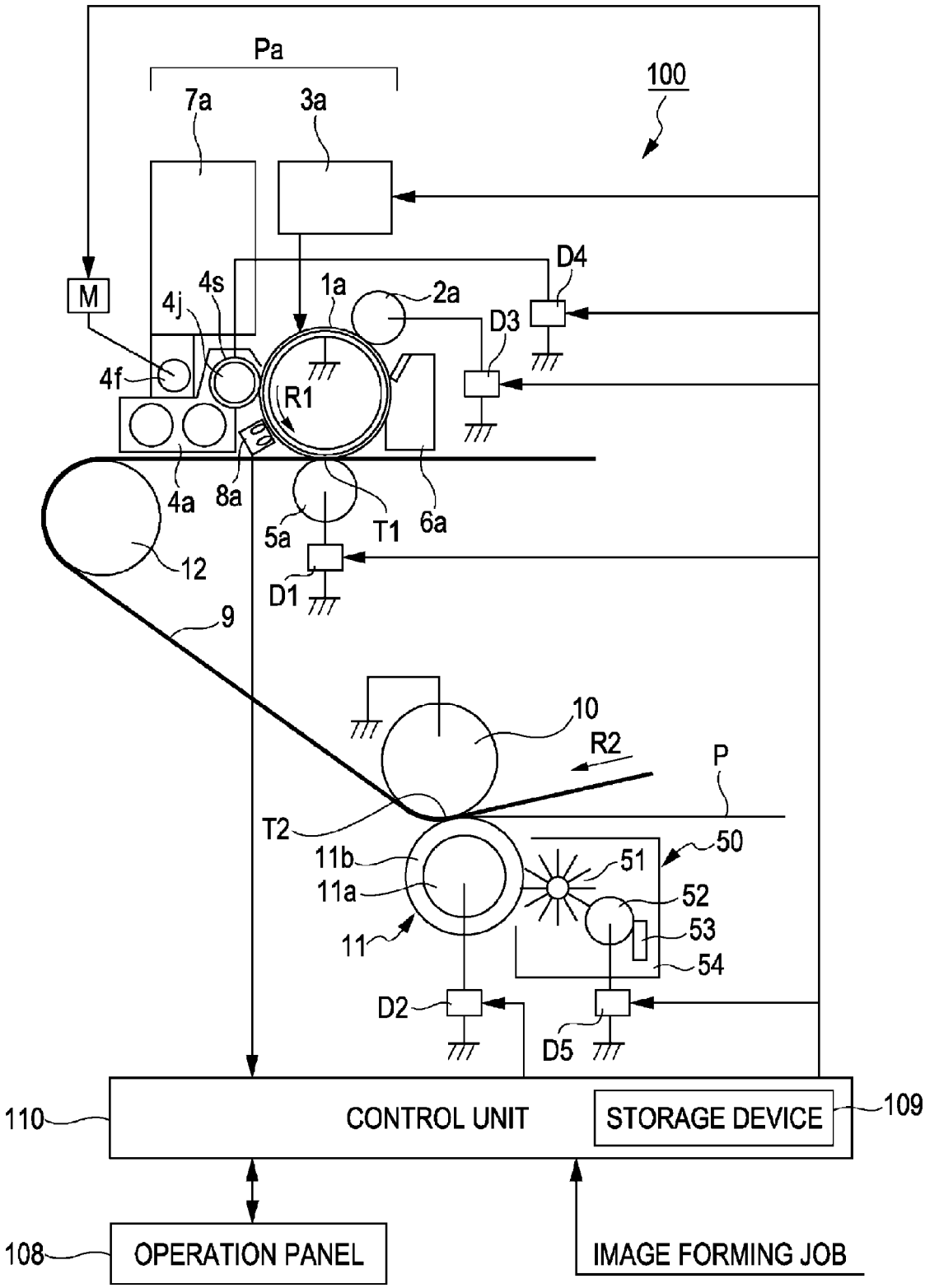
FIG. 2 illustrates a configuration of an image forming unit and a secondary transfer section.

FIG. 1A and FIG. 1B each illustrate a configuration of an image forming apparatus according to a first exemplary embodiment of the present invention. Specifically, FIG. 1A illustrates the image forming apparatus in a full-color mode and FIG. 1B illustrates the image forming apparatus in a black monochrome mode. FIG. 2 illustrates a configuration of an image forming unit and a secondary transfer section.

As illustrated in FIG. 1A, an image forming apparatus 100 of the first exemplary embodiment is a tandem full-color copier in which a plurality of photoconductive drums 1*a*, 1*b*, 1*c*, and 1*d* serving as image bearing members are arranged along an intermediate transfer belt 9 serving as a belt member or an intermediate transfer member.

In an image forming unit Pa, a yellow toner image is formed on the photoconductive drum 1*a* and primary-transferred onto the intermediate transfer belt 9. In an image forming unit Pb, a magenta toner image is formed on the photoconductive drum 1*b* and primary-transferred onto the yellow toner image on the intermediate transfer belt 9. Likewise, in an image forming unit Pc, a cyan toner image is formed on the photoconductive drum 1*c* and primary-transferred onto the magenta toner image on the intermediate transfer belt 9. Also, in an image forming unit Pd, a black toner image is formed on the photoconductive drum 1*d* and primary-transferred onto the cyan toner image on the intermediate transfer belt 9.

The four-color toner image primary-transferred onto the intermediate transfer belt 9 is conveyed to a secondary transfer section T2 and secondary-transferred onto a recording material P fed by registration rollers 23 to the secondary transfer section T2. The recording material P onto which the toner image has been secondary-transferred in the secondary transfer section T2 is subjected to heat and pressure by a fixing device 25. This causes the toner image to be fixed onto the surface of the recording material P, which is then discharged outside the image forming apparatus 100.

The intermediate transfer belt 9 is supported by a tension roller 12, a driving roller 13, and a backup roller 10 and runs in the direction of arrow R2 at a predetermined processing speed. The intermediate transfer belt 9 is given a support force of 30 N (3 kgf) by the tension roller 12, driven by the driving roller 13, and runs at a speed of 300 mm/second.

A separating device 22 separates recording materials P pulled out from a paper feed cassette 20 by a pickup roller 21 one by one, and sends each recording material P to the registration rollers 23. The registration rollers 23 receive the recording material P in a halting state, temporarily hold it, and send it to the secondary transfer section T2 simultaneously with the conveyance of the toner image on the intermediate transfer belt 9 to the secondary transfer section T2.

The image forming apparatus 100 executes a full-color mode (first image forming mode) for forming a full-color image on the recording material P and a black monochrome mode (second image forming mode) for forming a black monochrome image on the recording material P.

As illustrated in FIG. 1B, when the black monochrome mode is set, the image forming apparatus 100 separates, from the intermediate transfer belt 9, the image forming units Pa, Pb, and Pc for yellow, magenta, and cyan, respectively, which are not to be used. The photoconductive drums 1*a*, 1*b*, and 1*c* are separated from the intermediate transfer belt 9 by lowering the intermediate transfer belt 9 using a support roller 9*d* (moving member) as a point of curvature. Thus, the photoconductive drums 1*a*, 1*b*, and 1*c* in the image forming units Pa, Pb, and Pc, respectively, can be prevented from being worn out.

Configurations of the image forming units Pa, Pb, Pc, and Pd are the same, except that different toner colors (yellow, magenta, cyan, and black) are used in developing devices 4*a*, 4*b*, 4*c*, and 4*d* attached to the image forming units Pa, Pb, Pc, and Pd, respectively. The following describes the image forming unit Pa in detail. The other image forming units Pb, Pc, and Pd are configured in like manner.

As illustrated in FIG. 2, in the image forming unit Pa serving as a toner-image forming unit, the photoconductive drum 1*a* is surrounded by a charging device 2*a*, an exposure device 3*a*, the developing device 4*a*, a primary transfer roller 5*a*, and a cleaning device 6*a*.

The photoconductive drum 1*a* is obtained by forming a negatively-charged photosensitive layer on the outer surface of an aluminum cylinder. The photoconductive drum 1*a* is rotatably supported at its both ends. The photoconductive drum 1*a* is rotated in the direction of arrow R1 at a processing speed of 300 mm/second by a driving force transmitted from a driving motor (not shown) to an end of the photoconductive drum 1*a*.

The charging device 2*a* presses a charging roller into contact with the photoconductive drum 1*a* such that the charging roller is driven to rotate by the photoconductive drum 1*a*. The charging device 2*a* applies, from a power source D3, a voltage obtained by superimposing an alternating voltage on a direct voltage to the charging roller, thereby uniformly and negatively charging the surface of the photoconductive drum 1*a*.

The exposure device 3*a* uses a rotating mirror to scan the surface of the photoconductive drum 1*a* with a laser beam produced by ON-OFF modulating scanning-line image data obtained by expanding a yellow decomposed-color image. Thus, the exposure device 3*a* writes an electrostatic image onto the charged surface of the photoconductive drum 1*a*.

After negatively charging toner, the developing device 4*a* causes the toner to be carried in the form of a magnetic brush by a developing sleeve 4*s* rotating about a fixed magnetic pole 4*j* in the direction opposite the rotating direction of the photoconductive drum 1*a* thereby bringing the toner into sliding contact with the photoconductive drum 1*a*.

A power source D4 applies, to the developing sleeve 4*s*, a voltage obtained by superimposing an alternating voltage on a negative direct voltage. This causes the toner to move from the developing sleeve 4*s* to the electrostatic image on the photoconductive drum 1*a* whose polarity has become more positive than that of the developing sleeve 4*s*, thereby reverse-developing the electrostatic image.

The primary transfer roller 5*a* serving as a primary transfer member is biased at its both ends by a spring member (not shown), allows the intermediate transfer belt 9 to be introduced into the nip between the photoconductive drum 1*a* and the primary transfer roller 5*a*, and forms a primary transfer section T1 between the photoconductive drum 1*a* and the intermediate transfer belt 9.

The primary transfer roller 5*a* is obtained by forming a resistive elastic layer on the outer surface of a stainless roller shaft. The elastic layer is made of elastic material, such as ethylene-propylene-diene monomer (EPDM), ethylene-propylene monomer (EPM), nitrile-butadiene rubber (NBR), butadiene rubber (BR), or styrene-butadiene rubber (SBR), of a spongy structure having a resistance value adjusted to a value ranging from $1\times10^6$ to $1\times10^8$ Ωcm.

A power source D1 applies a positive direct voltage to the roller shaft of the primary transfer roller 5*a*. This causes the toner image negatively charged and carried by the photoconductive drum 1*a* to be electrically moved to the intermediate transfer belt 9 passing through the primary transfer section T1.

The cleaning device 6*a* brings a cleaning blade into sliding contact with the photoconductive drum 1*a* to remove toner that has passed through the primary transfer section T1 and remains untransferred on the surface of the photoconductive drum 1*a* thereby making a preparation for the subsequent formation of a toner image.

A control unit 110 serves as a controller and controls the image forming apparatus 100. An operation panel 108 constituted by a touch panel is used to operate and make settings of the control unit 110.

<Secondary Transfer Section>

The intermediate transfer belt 9 is an endless belt having a width of 370 mm and a perimeter of 900 mm. The intermediate transfer belt 9 carries and conveys the toner image primary-transferred at the primary transfer section T1 to the secondary transfer section T2. The intermediate transfer belt 9 is made of resin (e.g., polyimide, polycarbonate, polyester, polypropylene, polyethylene terephthalate, acrylic, or vinyl chloride), any one of various kinds of rubber, or the like.

The intermediate transfer belt 9 is 0.07 to 0.5 mm in thickness and contains an appropriate amount of carbon black serving as an antistatic agent. Thus, the volume resistivity ρ (Ωcm) of the intermediate transfer belt 9 is adjusted to $10^9$ (Ωcm). In view of transferability, it is preferable that the volume resistivity ρ (Ωcm) satisfy the following condition $10^5$ (Ωcm)$\leqq\rho\leqq10^{15}$ (Ωcm) when a JIS-K6911-compliant probe is used and a voltage of 100 V is applied for 60 seconds at a temperature of 23° C. and a relative humidity (RH) of 50%.

A cleaning device 19 (see FIG. 1A and FIG. 1B) brings a cleaning blade into sliding contact with the intermediate transfer belt 9 to remove toner that has passed through the secondary transfer section T2 and remains untransferred on the intermediate transfer belt 9.

The backup roller 10 is a cylindrical stainless member and is connected to a ground potential.

A secondary transfer roller 11 serving as a transfer member is pressed into contact with the backup roller 10 with the intermediate transfer belt 9 interposed therebetween. Thus, the secondary transfer section T2 is formed between the intermediate transfer belt 9 and the secondary transfer roller 11.

The secondary transfer roller 11 is obtained by forming an elastic layer 11*b* on the outer surface of a stainless roller shaft 11*a*. The elastic layer 11*b* includes an elastic rubber layer of ion-conductive rubber, such as urethane rubber, and a coating layer. The elastic rubber layer of the elastic layer 11*b* is made of foamed synthetic rubber material having a cell diameter of 0.05 to 1.0 mm and containing carbon black particles distributed therein. The coating layer on the outer surface of the elastic layer 11*b* is made of fluoroplastic material having a thickness of 0.1 to 1.0 mm and containing ion-conductive polymer particles distributed therein. Thus, a resistance value to be obtained when the secondary transfer roller 11 is brought into contact with a metal roller 52 having an outer diameter of 20 mm at a total pressure of 9.8 N, rotated at a speed of 20 rpm, and applied a voltage of 2 kV is adjusted to $1\times10^7$ (Ω). In view of secondary transferability, it is preferable that the resistance value R (Ω) of the secondary transfer roller 11 satisfy the following condition $1\times10^6\leqq R\leqq10^9$. The surface hardness of the secondary transfer roller 11 is 30 degrees in ASKER-C hardness.

A power source D2 serving as a power source applies a positive constant voltage, as a transfer voltage, to the roller shaft 11*a* of the secondary transfer roller 11 and causes a transfer current to flow in a series circuit including the backup roller 10, the intermediate transfer belt 9, the recording material P, and the secondary transfer roller 11. Thus, in the process where the recording material P placed over the toner image on the intermediate transfer belt 9 passes through the secondary transfer section T2, the toner image is electrostatically moved from the intermediate transfer belt 9 onto the recording material P.

Alternatively, the secondary transfer roller 11 may be connected to the ground potential to apply a negative transfer voltage to the backup roller 10. In either case, part of the transfer current flows through a toner loading portion of the intermediate transfer belt 9 and is involved in movement of toner from the intermediate transfer belt 9 to the recording material P.

In the first exemplary embodiment, a constant voltage output from the power source D2 during secondary transfer is set to 2.5 kV and a transfer current is set to 40 μA. However, since the constant voltage and the transfer current vary according to the type of recording material P, according to temperature and humidity, and according to changes in resistance of the secondary transfer roller 11 with time, the constant voltage and the transfer current are not limited to the values described above.

During the period in which image formation is not performed, the control unit 110 outputs a constant voltage for measurement purposes to measure a transfer current. On the basis of the measurement, the control unit 110 corrects, as necessary, a constant voltage to be output during image formation.

<Control Toner Image>

Figure 3:
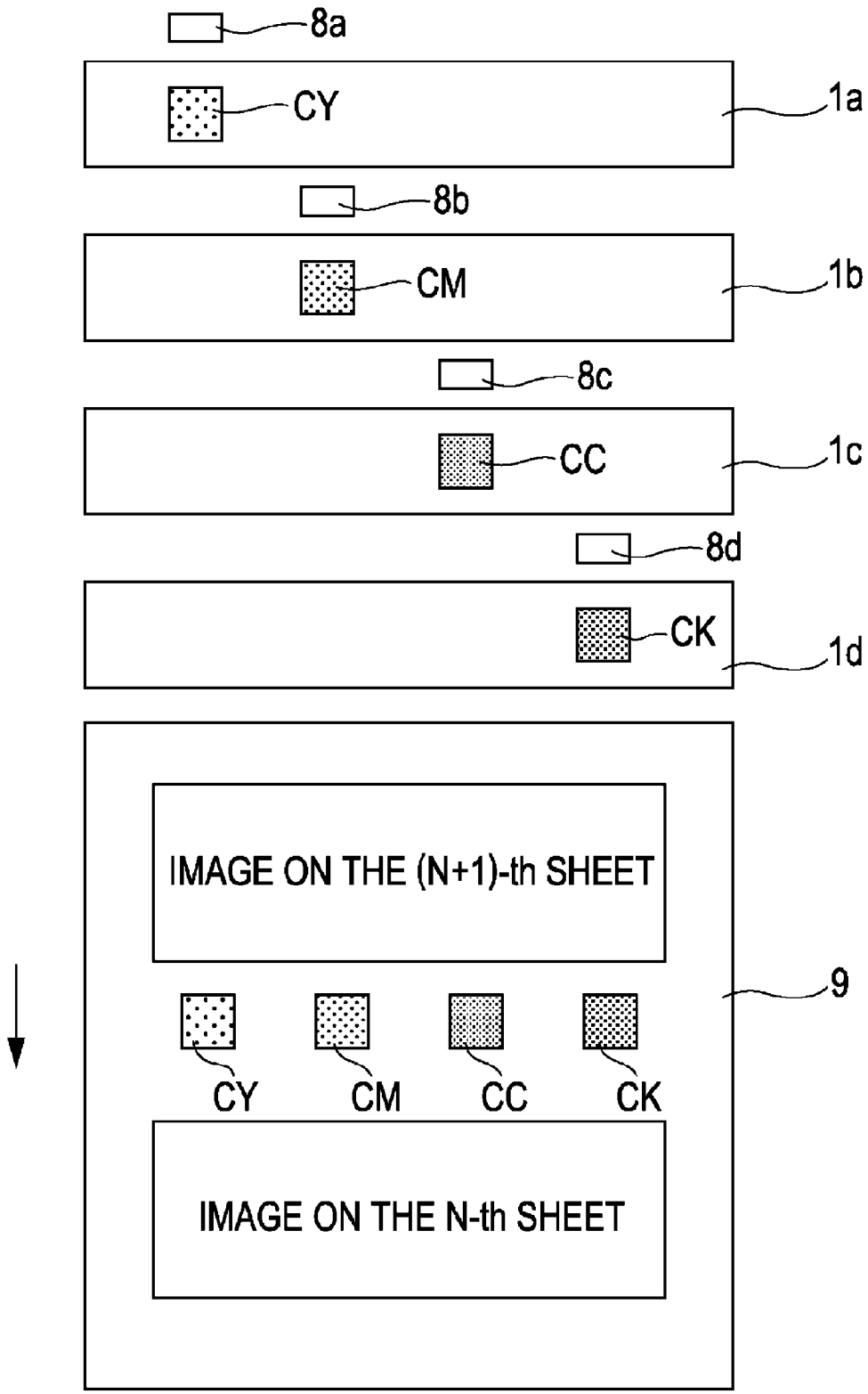
FIG. 3 illustrates control toner images.
Figure 4:
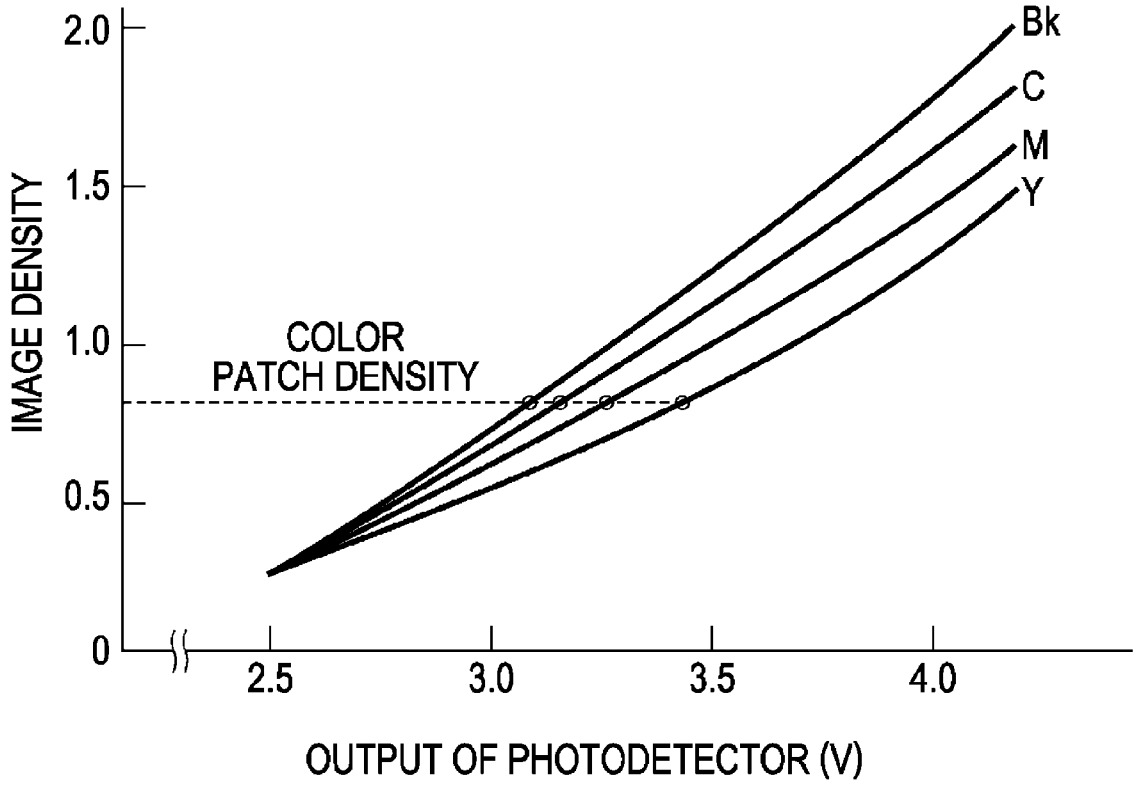
FIG. 4 is a graph showing a relationship between the output of a photodetector and the density of an image after being fixed.

FIG. 3 illustrates control toner images. FIG. 4 is a graph showing a relationship between the output of a photodetector and the density of an image after being fixed.

As illustrated in FIG. 3 with reference to FIG. 2, when the full-color mode is set, the control unit 110 forms a yellow color patch CY serving as a control toner image in a space between yellow toner images on the photoconductive drum 1*a*.

For higher control accuracy, a control toner image between images on the intermediate transfer belt 9 may be formed as frequently as possible. Particularly, in the full-color mode, since an adjustment for each color is used, a larger number of control toner images are formed more frequently than in the black monochrome mode.

As in the case of a toner image of an image to be printed, the color patch CY is formed on the photoconductive drum 1*a* in the following manner. In particular, an electrostatic image written by the exposure device 3*a* is developed by the developing device 4*a* and formed as the color patch CY on the photoconductive drum 1*a*.

A photodetector 8*a* detects diffuse reflected light produced when the color patch CY is irradiated with infrared light. Then, the photodetector 8*a* outputs, to the control unit 110, an analog voltage corresponding to the amount of toner loaded on the color patch CY. The photodetectors 8*a*, 8*b*, 8*c*, and 8*d* are detecting members that detect control toner images.

Magenta, cyan, and black color patches CM, CC, and CK which also serve as control toner images are formed on the photoconductive drums 1*b*, 1*c*, and 1*d*, respectively.

The color patches CY, CM, CC, and CK are formed in a space between a toner image on the N-th sheet and a toner image on the (N+1)-th sheet. The color patches CY, CM, CC, and CK having a square shape of 25 mm by 25 mm are displaced from each other in the axial direction of the photoconductive drums 1*a*, 1*b*, 1*c*, and 1*d*.

The color patches CY, CM, CC, and CK are arranged at intervals of 50 mm in the axial direction of the photoconductive drums 1*a*, 1*b*, 1*c*, and 1*d*. This is because a secondary-transfer-roller cleaning device 50 (described below) need not have a cleaning capability sufficient to completely remove overlapping color patches CY, CM, CC, and CK by single passing through them. For example, an electrostatic cleaning device with a fur brush has electrical limitations in terms of the amount of loaded toner that can be cleaned off at one time.

As shown in FIG. 4 with reference to FIG. 2, image densities obtained after fixing of toner images correspond to analog voltages output by the photodetectors 8*a*, 8*b*, 8*c*, and 8*d* upon detection of the control toner images. Exposure signals are generated for the color patches CY, CM, CC, and CK, each having multiple levels of density gradation levels represented by 8-bit data for each color.

On the basis of the results of detection of the color patches CY, CM, CC, and CK performed by the detecting members, the control unit 110 (which performs control operations described in detail below) adjusts image forming conditions of the image forming units. In the present exemplary embodiment, the detecting members detect the amounts of toner loaded on the color patches CY, CM, CC, and CK.

From the amounts of toner loaded on the color patches CY, CM, CC, and CK, the control unit 110 evaluates the current conditions of toner image formation. Then, the control unit 110 corrects the image forming conditions so as to bring the results of detection of the color patches CY, CM, CC, and CK closer to a predetermined density value (e.g., 120/256).

On the basis of determination as to whether the amount of toner supplied to the developing device 4*a* is appropriate, the control unit 110 drives a motor M that actuates a toner supply roller 4*f*. Thus, the control unit 110 adjusts the amount of toner to be supplied from a toner supply bottle 7*a* to the developing device 4*a*.

When it becomes impossible to obtain a predetermined amount of loaded toner within the range of adjustment of the toner supply roller 4*f*, the control unit 110 varies a direct voltage output from the power source D4 to adjust the amount of toner adhering to an equivalent electrostatic image.

When it becomes impossible to obtain a predetermined amount of loaded toner within the range of adjustment of the direct voltage output from the power source D4, the control unit 110 varies the quantity of laser light output from the exposure device 3*a* to adjust the electrostatic image.

<Secondary-Transfer-Roller Cleaning Device>

Figure 5:
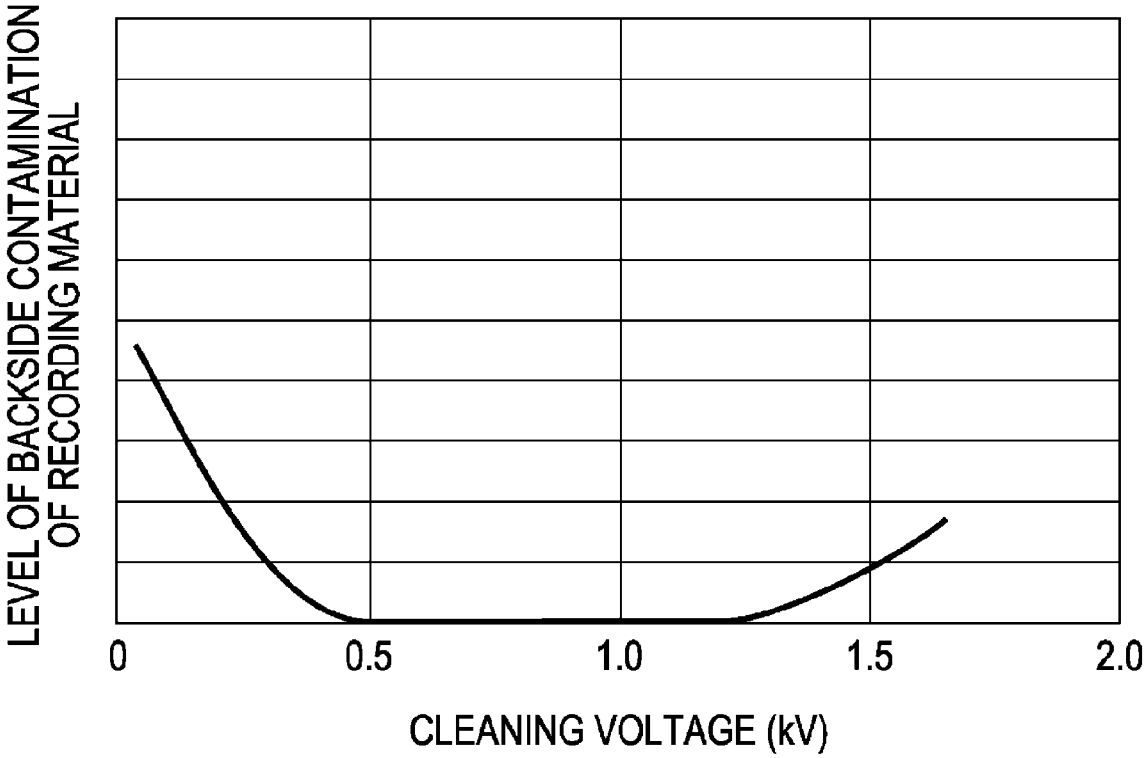
FIG. 5 is a graph showing cleaning characteristics of a secondary-transfer-roller cleaning device.

FIG. 5 is a graph showing cleaning characteristics of a secondary-transfer-roller cleaning device.

The color patches CY, CM, CC, and CK, which are formed in a conveyance interval (so-called inter-sheet gap) between adjacent recording materials P, are not secondary-transferred to a recording material P passing through the secondary transfer section T2. Rather, these color patches are secondary-transferred to the secondary transfer roller 11.

The toner adhering to the secondary transfer roller 11 rotates once and is moved to the backside of the recording material P passing through the secondary transfer section T2. Then, the toner is fixed by the fixing device 25 (see FIG. 1) and causes backside contamination of the recording material P.

If the secondary transfer roller 11 is separated from the intermediate transfer belt 9 at conveyance intervals between adjacent recording materials P, it is possible to prevent the color patches CY, CM, CC, and CK from being transferred to the secondary transfer roller 11. Alternatively, if the polarity of a voltage output from the power source D2 is reversed at conveyance intervals between adjacent recording materials P, it is possible to push the color patches CY, CM, CC, and CK back to the intermediate transfer belt 9.

However, to achieve high productivity, the image forming apparatus 100 performs processing at a high speed and distances between adjacent recording materials P are reduced. Therefore, it is temporally difficult both to separate the secondary transfer roller 11 and to reverse the output from the power source D2 at conveyance intervals between adjacent recording materials P.

Instead, to keep a clean surface of the secondary transfer roller 11 passing through the secondary transfer section T2, the high-performance secondary-transfer-roller cleaning device 50 (see FIG. 2) is attached to the secondary transfer roller 11. The secondary-transfer-roller cleaning device 50 has a cleaning capability to substantially completely remove, by single passage, halftone control toner images from the surface of the secondary transfer roller 11.

As illustrated in FIG. 2, the secondary-transfer-roller cleaning device 50 allows a fur brush 51 serving as a conductive brush member to be in contact with a portion of the surface of the secondary transfer roller 11, the portion being located downstream of the secondary transfer section T2.

The fur brush 51 is cylindrical in shape, 20 mm in outer diameter, and 370 mm in length. The density of bristles on the fur brush 51 is set to 500,000/inch$^2$, the length of the bristles is set to 5 mm, and the amount of insertion of the bristles into the secondary transfer roller 11 is set to 1.0 mm. The resistance value of the fur brush 51 that is measured when the fur brush 51 is inserted 1 mm into the metal roller 52, rotated at a speed of 100 rpm, and applied a voltage of 100 V is $1\times10^7$ (Ω).

The fur brush 51 rotates at a peripheral speed that is 20% that of the secondary transfer roller 11 by a driving force distributed from a driving system of the secondary transfer roller 11. Thus, the fur brush 51 makes sliding contact with the surface of the secondary transfer roller 11 in a direction opposite the rotation of the secondary transfer roller 11.

The metal roller 52 is a cylindrical stainless member. The metal roller 52 rotates at a peripheral speed that is 120% that of the fur brush 51 in the same direction as the rotation of the fur brush 51 and receives toner from the fur brush 51. The fur brush 51 and the metal roller 52 rotate in an electrically floating state.

A cleaning blade 53 is made of urethane rubber. The cleaning blade 53 brings its end into sliding contact with the metal roller 52. Thus, the cleaning blade 53 scrapes toner off the surface of the metal roller 52 into a waste container 54.

During rotation of the secondary transfer roller 11, a power source D5 continues applying a positive voltage to the metal roller 52 so as to cause a cleaning current to flow through a series circuit including the secondary transfer roller 11, the fur brush 51, and the metal roller 52. Thus, the fur brush 51 becomes positive with respect to the secondary transfer roller 11, while the metal roller 52 becomes positive with respect to the fur brush 51. Toner particles negatively charged and attached to the surface of the secondary transfer roller 11 are electrostatically moved to the fur brush 51, electrostatically moved further to the metal roller 52, and collected by the cleaning blade 53 into the waste container 54.

As shown in FIG. 5 with reference to FIG. 2, when the power source D5 changes the voltage output to the metal roller 52, the cleaning performance of the secondary-transfer-roller cleaning device 50 changes accordingly.

As shown in FIG. 5, the control toner images can be completely cleaned off when the cleaning voltage is in about the 0.5 to 1 kV range. However, when a voltage of about 1 kV is exceeded, the cleaning performance of the secondary-transfer-roller cleaning device 50 is degraded. In particular, when a voltage of 1 kV, which is a discharge starting voltage, is exceeded, the charging polarity of toner particles adhering to the fur brush 51 is reversed. This triggers a gradual development of phenomenon in which the toner particles adhere to the secondary transfer roller 11 again.

On the basis of the result of this experiment, the output voltage of the power source D4 is set to 0.6 kV. This makes it possible that when standard A4-size recording materials P are successively conveyed in a transverse feed direction at intervals of 70 mm for image formation thereon, the control toner images carried in a region corresponding to a conveyance interval on the secondary transfer roller 11 can be completely cleaned off and cause no backside contamination of the subsequent recording material P. The voltage setting may vary depending on the type of toner and environmental conditions, and thus is not limited to the value described above.

<Black Monochrome Mode>

Figure 6:
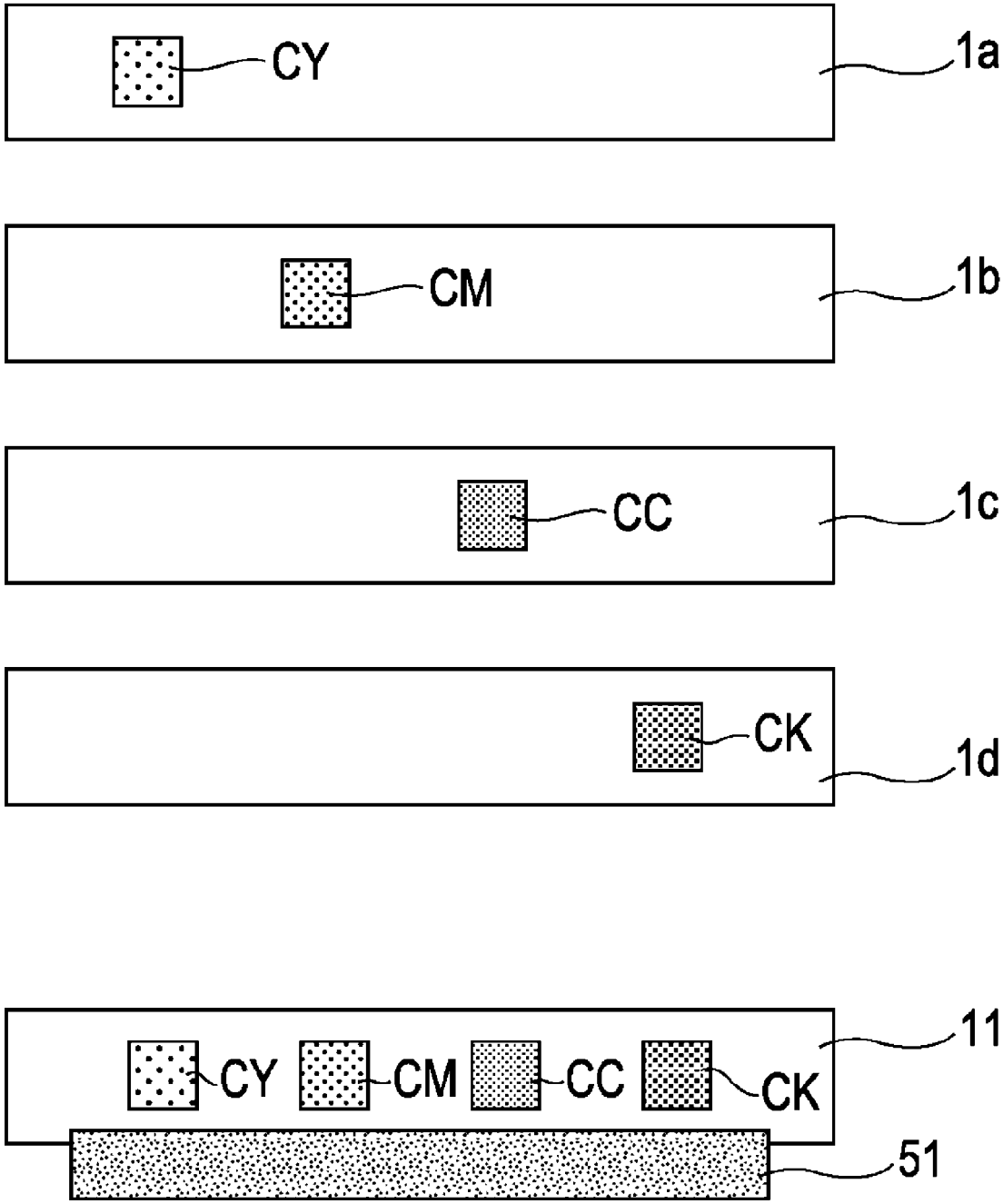
FIG. 6 illustrates control toner images in a full-color mode.
Figure 7:
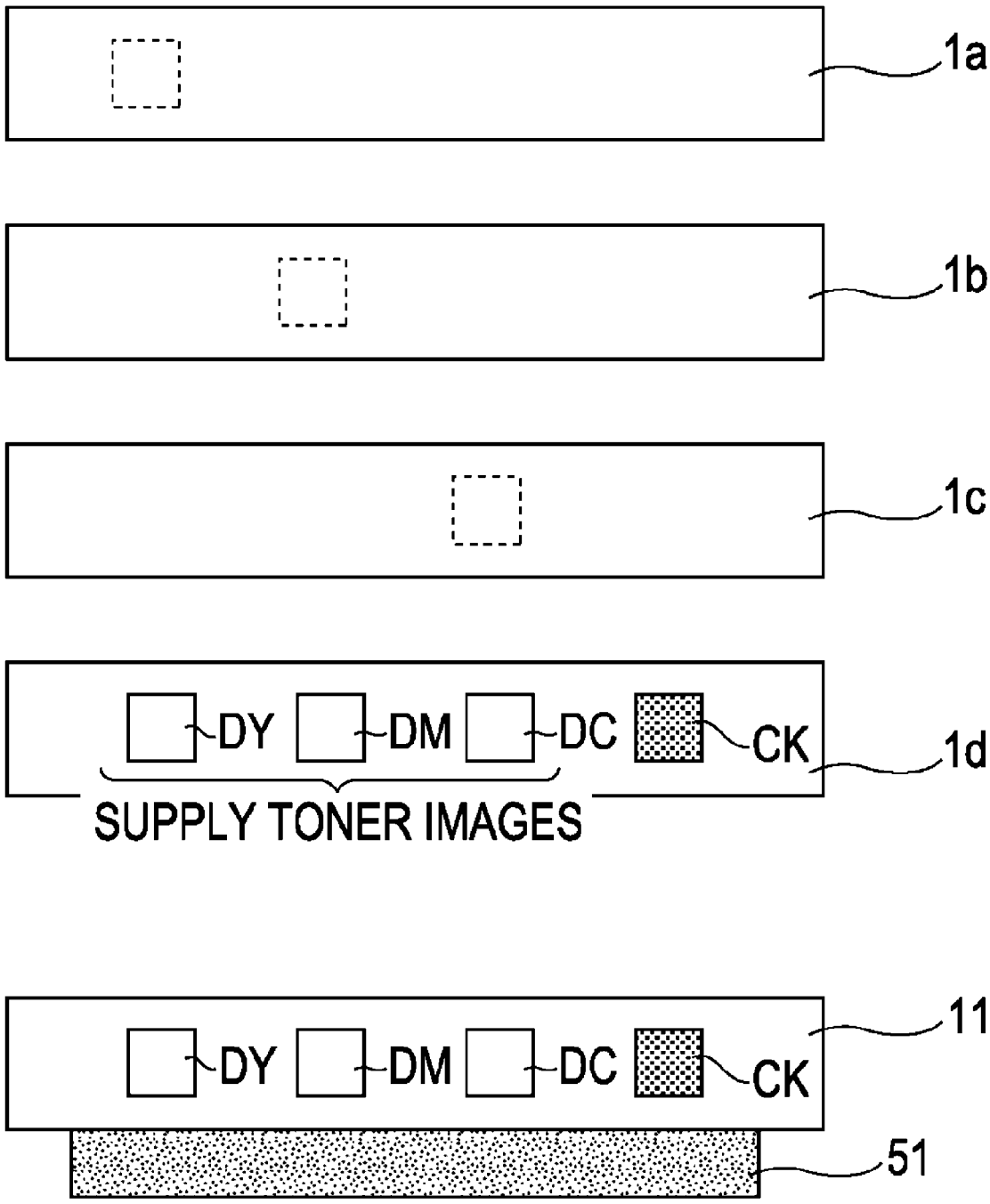
FIG. 7 illustrates a control toner image in a black monochrome mode.

FIG. 6 illustrates control toner images in the full-color mode. FIG. 7 illustrates a control toner image in the black monochrome mode.

As illustrated in FIG. 6 with reference to FIG. 2, in the full-color mode, the color patches CY, CM, CC, and CK formed on the photoconductive drums 1*a*, 1*b*, 1*c*, and 1*d*, respectively, and serving as control toner images, are carried by the intermediate transfer belt 9 and secondary-transferred onto the secondary transfer roller 11. Therefore, every time secondary transfer is performed on the recording material P, the fur brush 51 comes into contact with the color patches CY, CM, CC, and CK and is refreshed. Because of the arrangement of the detecting members that detect the control toner images, the control toner images are formed in a predetermined region in the rotational axis direction of the transfer member (image bearing members).

Discharge products (e.g., nitrogen oxides) formed at the secondary transfer section T2, attached to the secondary transfer roller 11, dragged, and attached to the surface of the fur brush 51 can be removed by toner particles of the color patches CY, CM, CC, and CK. When discharge products excessively adhere to the fur brush 51, the capability of the fur brush 51 to attract toner particles is slightly degraded. As a result, the cleaning capability of the fur brush 51 to remove the color patches CY, CM, CC, and CK is degraded.

As illustrated in FIG. 7 with reference to FIG. 2, in the black monochrome mode, the intermediate transfer belt 9 does not carry the color patches CY, CM, and CC. As illustrated in FIG. 1B, this is because the image forming units Pa, Pb, and Pc are separated from the intermediate transfer belt 9. At the same time, since the image forming units Pa, Pb, and Pc that are not to be used for image formation are in a non-operating mode, they do not form control toner images of yellow, magenta, and cyan.

Since only the color patch CK of black is carried between adjacent toner images carried by the intermediate transfer belt 9, the color patches CY, CM, and CC do not refresh the fur brush 51 via the secondary transfer roller 11.

Therefore, only part of the fur brush 51 coming into contact with the color patch CK is refreshed and maintains its cleaning capability to remove the color patch CK with a small number of revolutions. Then, part of the fur brush 51 coming into contact with the color patches CY, CM, and CC is not refreshed, accumulates discharge products thereon, and becomes unable to make use of its cleaning capability to remove the color patches CY, CM, and CC with a small number of revolutions.

Thus, when the black monochrome mode ends and the full-color mode is returned, the color patches CY, CM, and CC transferred to the secondary transfer roller 11 are not sufficiently removed with a small number of revolutions. Then, the residual part of the color patches CY, CM, and CC is dragged by the secondary transfer roller 11 and attached to the backside of the recording material P.

Therefore, the control unit 110 uses the image forming unit Pd that can be used in the black monochrome mode to cause the intermediate transfer belt 9 to carry supply toner images DY, DM, and DC corresponding to the positions of the color patches CY, CM, and CC, respectively, in the rotational axis direction described above. This is because using toner of one color currently used is less difficult than using toner of a plurality of other colors.

The control unit 110 controls an exposure device 3*d* serving as a toner-image forming unit to form the supply toner images DY, DM, and DC on the photoconductive drum 1*d*. The supply toner images DY, DM, and DC are intended for use in refreshing the fur brush 51 and are not used in adjusting toner-image forming conditions of the image forming unit Pd.

Thus, during the period of the black monochrome mode, part of the fur brush 51 coming into contact with the color patches CY, CM, and CC is refreshed by the supply toner images DY, DM, and DC. Then, by supplying toner only to the region where the color patches CY, CM, and CC are formed, the amount of toner consumption can be made smaller than that in the case where toner is supplied to form toner images across the entire width in the rotational axis direction of the photoconductive drum 1*d*.

An attraction force of discharge products to toner is greater than that to the fur brush 51. When the supply toner images DY, DM, and DC are brought into contact with the fur brush 51, discharge products adhering to the fur brush 51 are moved to the toner. Therefore, the fur brush 51 can be refreshed by causing the discharge products to adhere to the toner and moving the toner to the metal roller 52.

Thus, when the black monochrome mode ends and the full-color mode is returned, since the color patches CY, CM, and CC transferred to the secondary transfer roller 11 can be sufficiently removed by single passage, there is no occurrence of backside contamination of the recording material P.

Example 1

Figure 8:
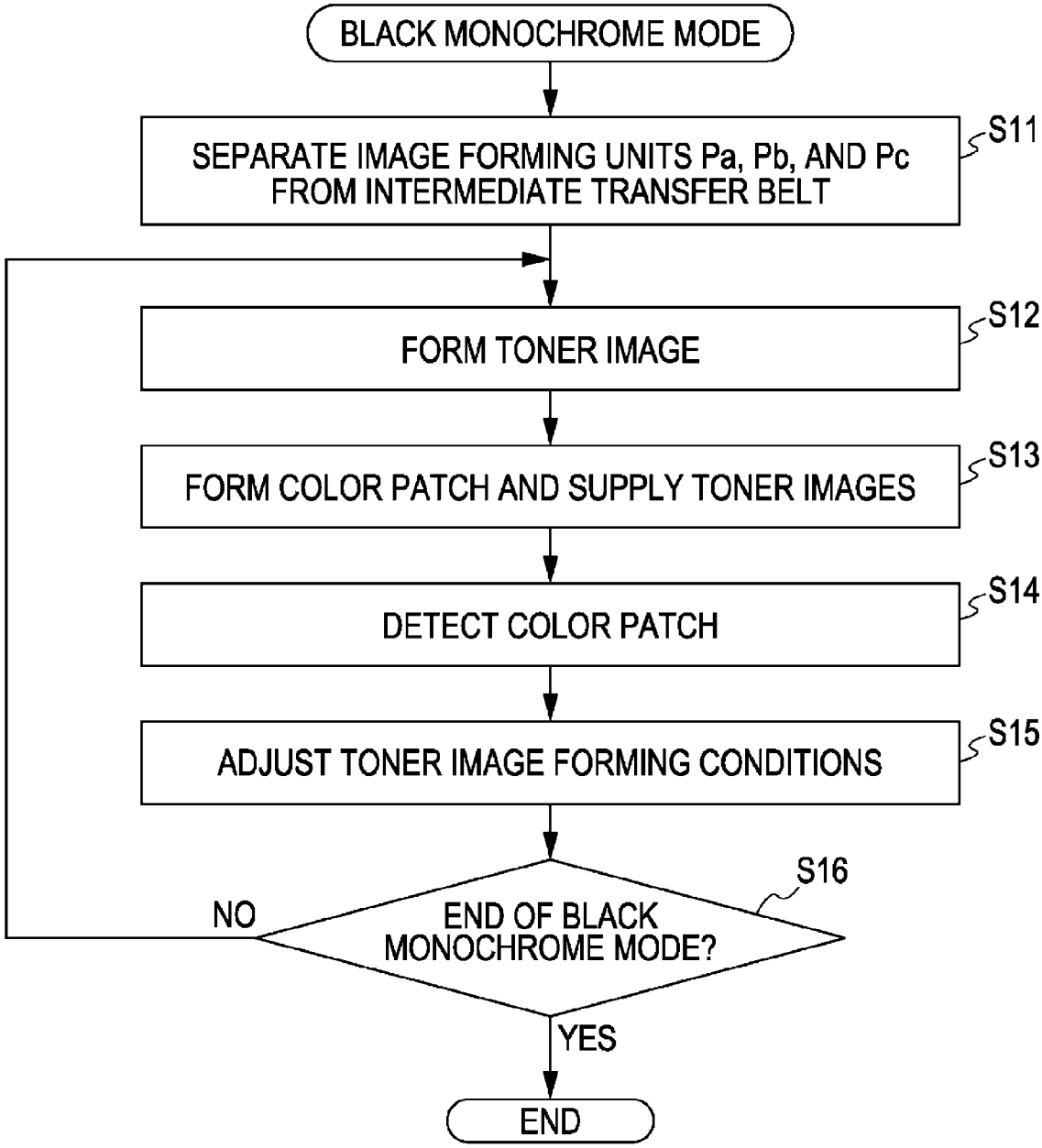
FIG. 8 is a flowchart illustrating a procedure performed in the black monochrome mode.

FIG. 8 is a flowchart illustrating a procedure performed in the black monochrome mode. Switching between the full-color mode and the black monochrome mode is determined by input of mode selection information to the control unit 110. A mode selection unit is provided in a display unit of the image forming apparatus 100. When image information is externally input to the image forming apparatus 100, the mode selection can be made externally.

In Example 1, in every space (inter-sheet gap) between adjacent toner images on the intermediate transfer belt 9, the color patch CK and the supply toner images DY, DM, and DC are formed and carried by the intermediate transfer belt 9.

As illustrated in FIG. 8 with reference to FIG. 1B, when the black monochrome mode is set on the operation panel 108, the control unit 110 separates the image forming units Pa, Pb, and Pc from the intermediate transfer belt 9 (step S11).

The control unit 110 controls the image forming unit Pd to form a toner image of an image to be transferred to the recording material P (step S12) and also form the color patch CK and the supply toner images DY, DM, and DC illustrated in FIG. 7 (step S13).

The control unit 110 detects the color patch CK with the photodetector 8*d* (step S14) and adjusts the toner-image forming conditions of the image forming unit Pd (step S15).

The control unit 110 continues performing the control operations of steps S12 to S16 until image formation in the black monochrome mode ends (YES in step S16).

The supply toner images DY, DM, and DC have the same width (measure in the axial direction of the secondary transfer roller 11) in the range of 23 to 27 mm. The width of the supply toner images DY, DM, and DC is within ±2 mm of the width 25 mm of the color patches CY, CM, and CC.

In the embodiment, "the supply toner images DY, DM, and DC have the same width" indicates that the supply toner images DY, DM, and DC have the same width within ±2 mm of that of the color patches CY, CM, and CC, respectively. Even if the width is 2 mm greater than that of the color patches CY, CM, and CC, the amount of toner consumed by forming the supply toner images DY, DM, and DC is sufficiently small. Even if the width is 2 mm smaller than that of the color patches CY, CM, and CC, the region of the color patches can be sufficiently refreshed since toner collected by the fur brush 51 is stirred by the fur brush 51 and moved in the rotational axis direction.

However, if the width of the supply toner images DY, DM, and DC is much smaller than that of the color patches CY, CM, and CC, part of the fur brush 51 coming into contact with the color patches CY, CM, and CC is not thoroughly refreshed.

Moreover, since part of the fur brush 51 not coming into contact with the color patches CY, CM, and CC is not refreshed even in the full-color mode, the surface of the fur brush 51 is covered with a thick layer of discharge products and thus, the cleaning capability of the fur brush 51 is significantly degraded.

Therefore, if the width of the supply toner images DY, DM, and DC is too large, part of the supply toner images DY, DM, and DC extending outside the color patches CY, CM, and CC is not completely removed by single passage. Then, a cleaning failure caused by the supply toner images DY, DM, and DC occurs during execution of the black monochrome mode. From this point of view, it is reasonable again to supply toner only to the color patch region where backside contamination tends to occur.

Part of the fur brush 51 not coming into contact with the color patches CY, CM, and CC has only a light load of toner covering the intermediate transfer belt 9. Therefore, it is originally not even necessary to refresh such part of the fur brush 51. It is also not necessary, for example, to form a series of supply toner images throughout the length of the fur brush 51 and waste black toner at a position where there is no need to perform refreshing.

For example, the length of the supply toner images DY, DM, and DC, (i.e., length in the rotational direction of the secondary transfer roller 11), may be set to a value that ensures the amount of toner necessary to refresh the fur brush 51 and does not exceed a conveyance interval between adjacent recording materials P.

In the image forming apparatus 100, a constant voltage is applied to the secondary transfer roller 11 and discharge products are accumulated on the fur brush 51 even during the periods of returning of a door or a cassette, rotation before or after image formation, and periodic adjustment of a constant voltage.

During continuous image formation, discharge products are removed from the fur brush 51, to some extent, by the recording material P that passes through the secondary transfer section T2. However, during the above-described periods in which no recording material P is supplied, the amount of discharge products attached to the fur brush 51 via the secondary transfer roller 11 is significantly increased.

Therefore, in image formation in the black monochrome mode that follows any of the control operations described above, the supply toner images DY, DM, and DC are formed immediately after the first formation of a toner image. Thus, image formation is started after the fur brush 51 whose cleaning capability has been degraded through any of the above-described control operations is refreshed.

Example 2

Figure 9:
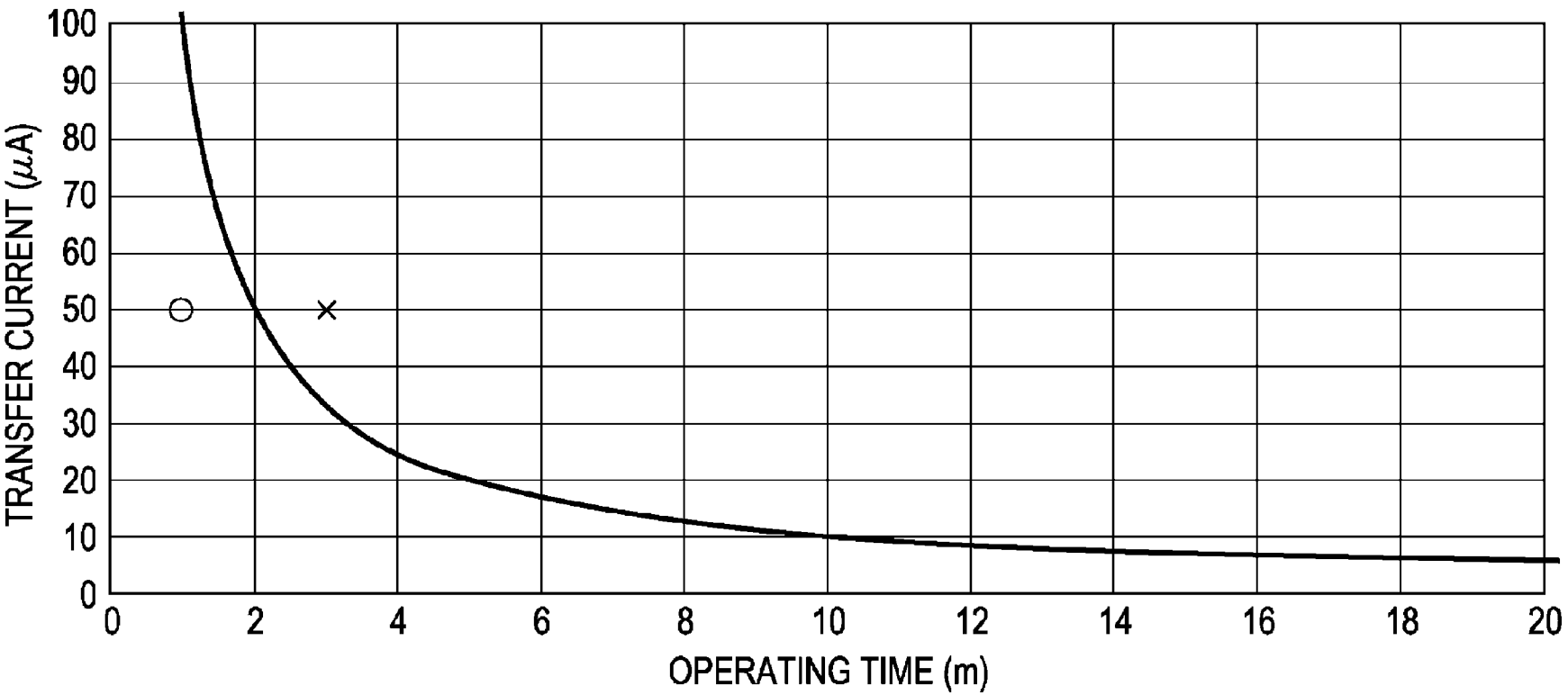
FIG. 9 is a graph showing conditions of occurrence of backside contamination on a recording material in the black monochrome mode.

FIG. 9 is a graph showing conditions of occurrence of backside contamination on a recording material in the black monochrome mode.

As shown in FIG. 9 with reference to FIG. 2, a constant voltage output from the power source D2 was varied to examine the relationship between the time during which the black monochrome mode continues and the occurrence of backside contamination of the recording material. The result confirms that backside contamination had occurred in the region to the upper-right of the curve in the graph, and an increase in voltage applied to the secondary transfer section T2 had caused an increase in the amount of discharge products and had resulted in occurrence of backside contamination in a shorter period of time. Backside contamination tends to occur particularly during continuous transfer operation in which the level of voltage output from the power source D2 is high and the amount of transfer current is large.

For example, if a transfer current is set to 40 μA in the secondary transfer section T2 and the black monochrome mode continues for 3 minutes, backside contamination caused by the color patches CY, CM, and CC may occur in the recording material P when the full-color mode is returned.

Conversely, if the supply toner images DY, DM, and DC are formed every 3 minutes, not every formation of a toner image, it is possible to maintain the cleaning capability to completely remove the color patch CK by single passage.

Therefore, in Example 2, control is performed such that only the color patch CK is formed after every formation of a toner image, while the supply toner images DY, DM, and DC are formed in line with the color patch CK at predetermined time intervals.

The control unit 110 refers to a lookup table stored in a storage device 109 for a function of the graph of FIG. 9 in setting the transfer current, and sets intervals of formation of the supply toner images DY, DM, and DC.

Thus, as compared to Example 1, the cumulative amount of toner used in forming the supply toner images DY, DM, and DC can be reduced, and the consumption of black toner can be saved.

FIG. 9 illustrates cleaning characteristics with respect to a time interval between the time when a control toner image passes through the secondary transfer section T2 and the time when the subsequent control toner image passes through the secondary transfer section T2, by showing the relationship between the time interval and a value of current (transfer current) that flows through the secondary transfer section T2. In FIG. 9, the vertical axis represents the transfer current and the horizontal axis represents the time interval (refresh time interval).

A cleaning failure caused by the control toner images (color patches) CY, CM, and CC formed after formation of a toner image when the full-color mode is returned relates to the transfer current and the refresh time interval. If the transfer current is large, a cleaning failure occurs even if the refresh time interval is short, while if the transfer current is small, a cleaning failure does not occur even if the refresh time interval is long.

Here, a transfer current that flows when a control toner image and supply toner images pass through the secondary transfer section T2 is denoted by I (μA) and a time interval between the supply of successive supply toner images to the secondary transfer section T2 is denoted by t (m). Since the curve shown in FIG. 9 can be approximated by I×t=100, conditions not causing the occurrence of backside contamination of the recording material P stemming from the color patches CY, CM, and CC can be expressed as follows:

$$I \times t \leqq 100 (I \geqq 0) \qquad \text{Expression 1}$$

Example 3

Figure 10:
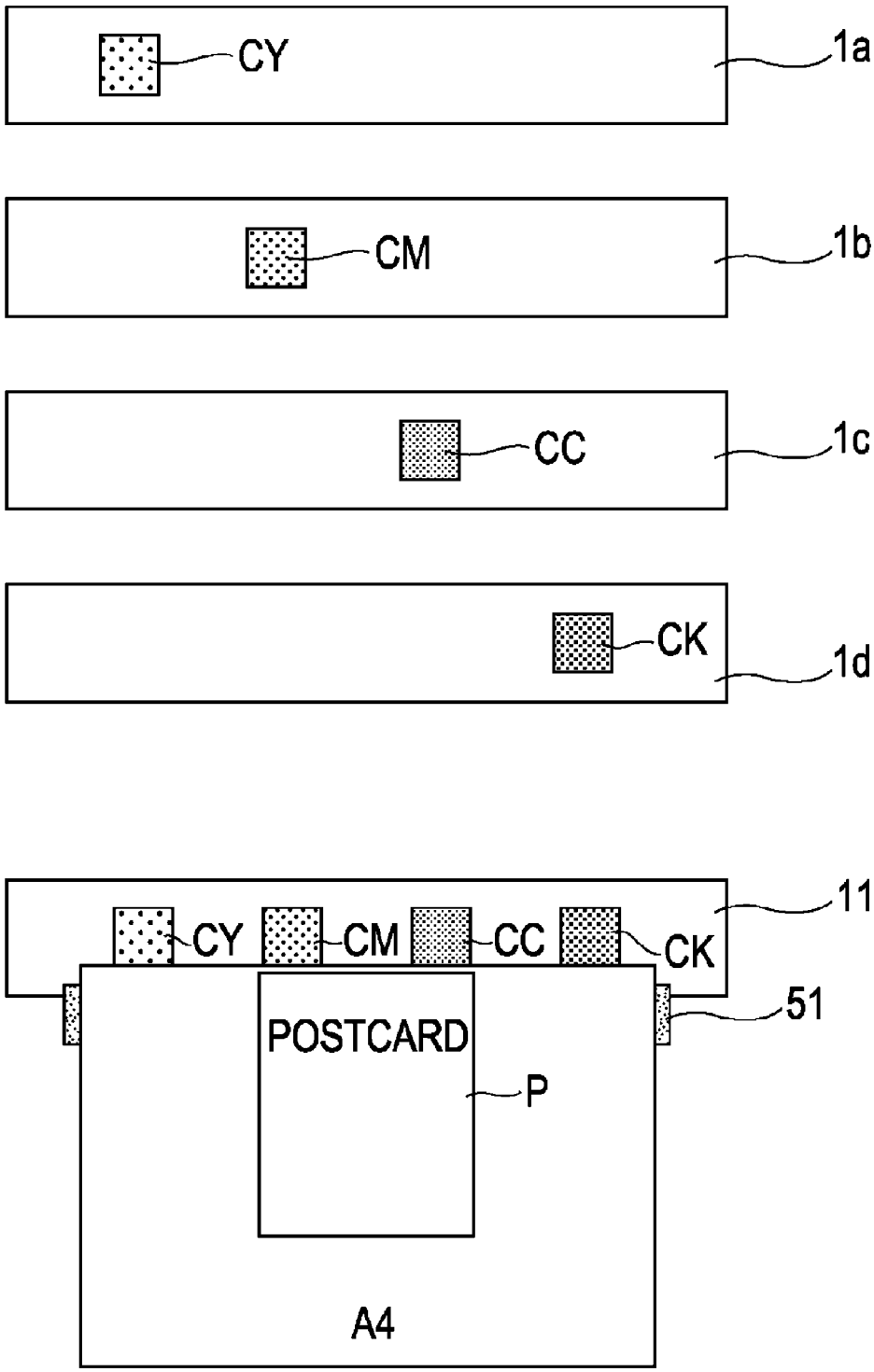
FIG. 10 illustrates secondary transfer preformed on a post-card-size recording material.
Figure 11:
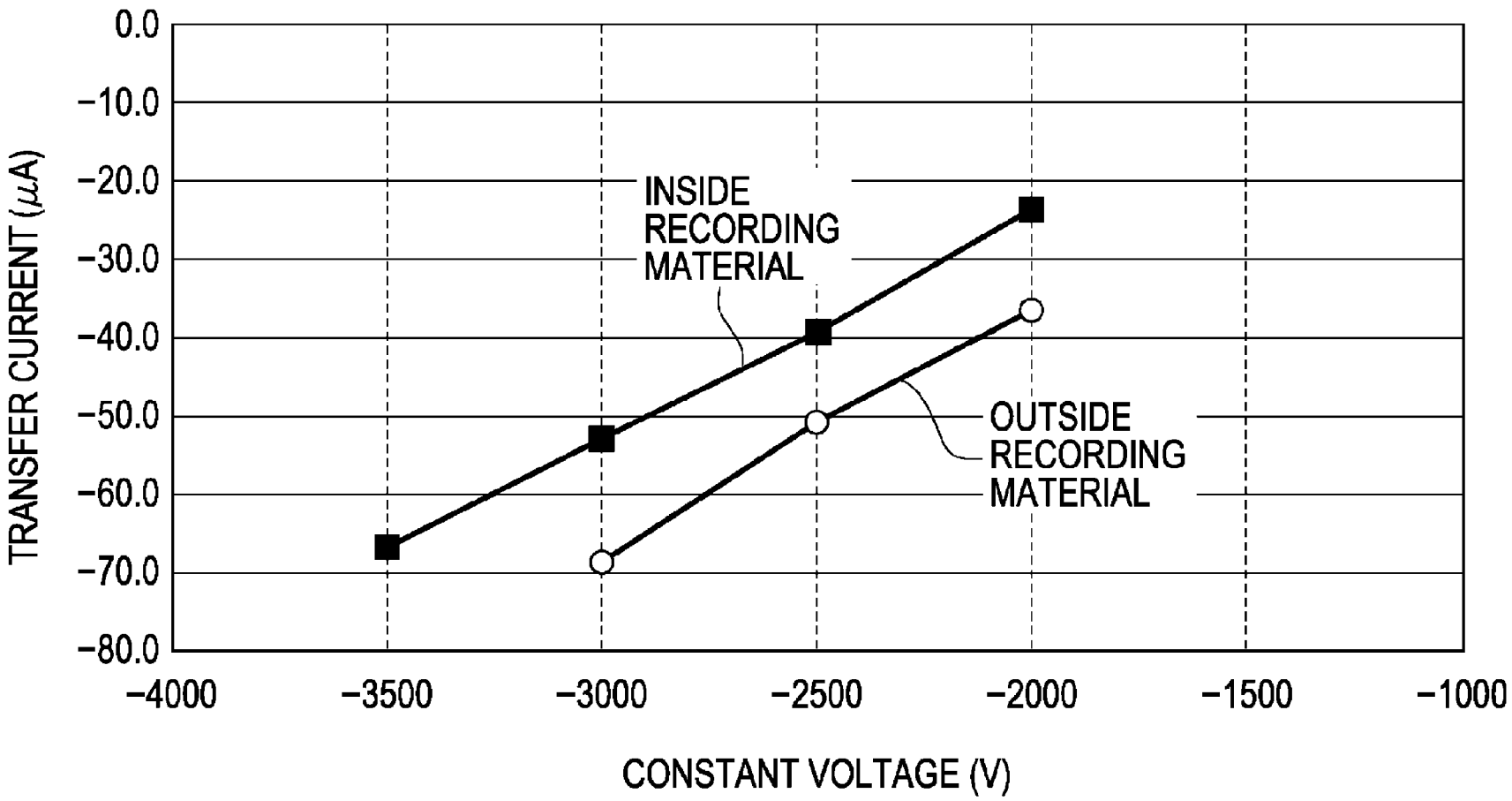
FIG. 11 is a graph comparing transfer currents inside and outside a recording material.

FIG. 10 illustrates secondary transfer preformed on a postcard-size recording material. FIG. 11 is a graph comparing transfer currents inside and outside a recording material.

As illustrated in FIG. 10 with reference to FIG. 2, to perform image formation on the recording material P of postcard size, the power source D2 applies a voltage of 2.5 kV to the secondary transfer roller 11 so as to form a transfer electric field in the secondary transfer section T2.

In this case, as shown in FIG. 11, a current density inside the recording material P corresponds to a transfer current of −40 μA, while a current density outside the recording material P corresponds to a transfer current of −50 μA, as there is no resistance of the recording material P.

As illustrated in FIG. 10 with reference to FIG. 2, a region bearing the magenta color patch CM and a region bearing the cyan color patch CC are located inside the recording material P. Therefore, discharge products corresponding to a transfer current of −40 μA are produced.

On the other hand, since a region bearing the black color patch CK and a region bearing the yellow color patch CY are located outside the recording material P, discharge products corresponding to a transfer current of −50 μA are produced.

Therefore, when continuous image formation is performed on 200 recording materials P in the black monochrome mode at a processing rate of 60 sheets per minute, I×t=50 μA×200 sheets/60 sheets=167>100 is given. Thus, when the full-color mode is returned, even if the color patches CM and CC can be completely cleaned off, a cleaning failure caused by the color patch CY may occur (see the cross mark in FIG. 9).

To prevent such failure, in Example 3, when continuous image formation is performed on the recording materials P of postcard size in the black monochrome mode, the supply toner images DY, DM, and DC illustrated in FIG. 7 are formed once every 100 sheets to refresh the fur brush 51.

Thus, although the amount of black toner consumed is larger than that in Example 2, I×t=50 μA×100 sheets/60 sheets=83<100 is given. Therefore, when the full-color mode is returned, a cleaning failure caused by the color patch CY can be prevented (see the circular mark in FIG. 9).

Alternatively, the frequency of formation of only the supply toner images DM and DC located inside the width of the recording material P may be increased and the frequency of formation of the supply toner image DY may be defined by the control performed in Example 2.

Example 4

Figure 12:
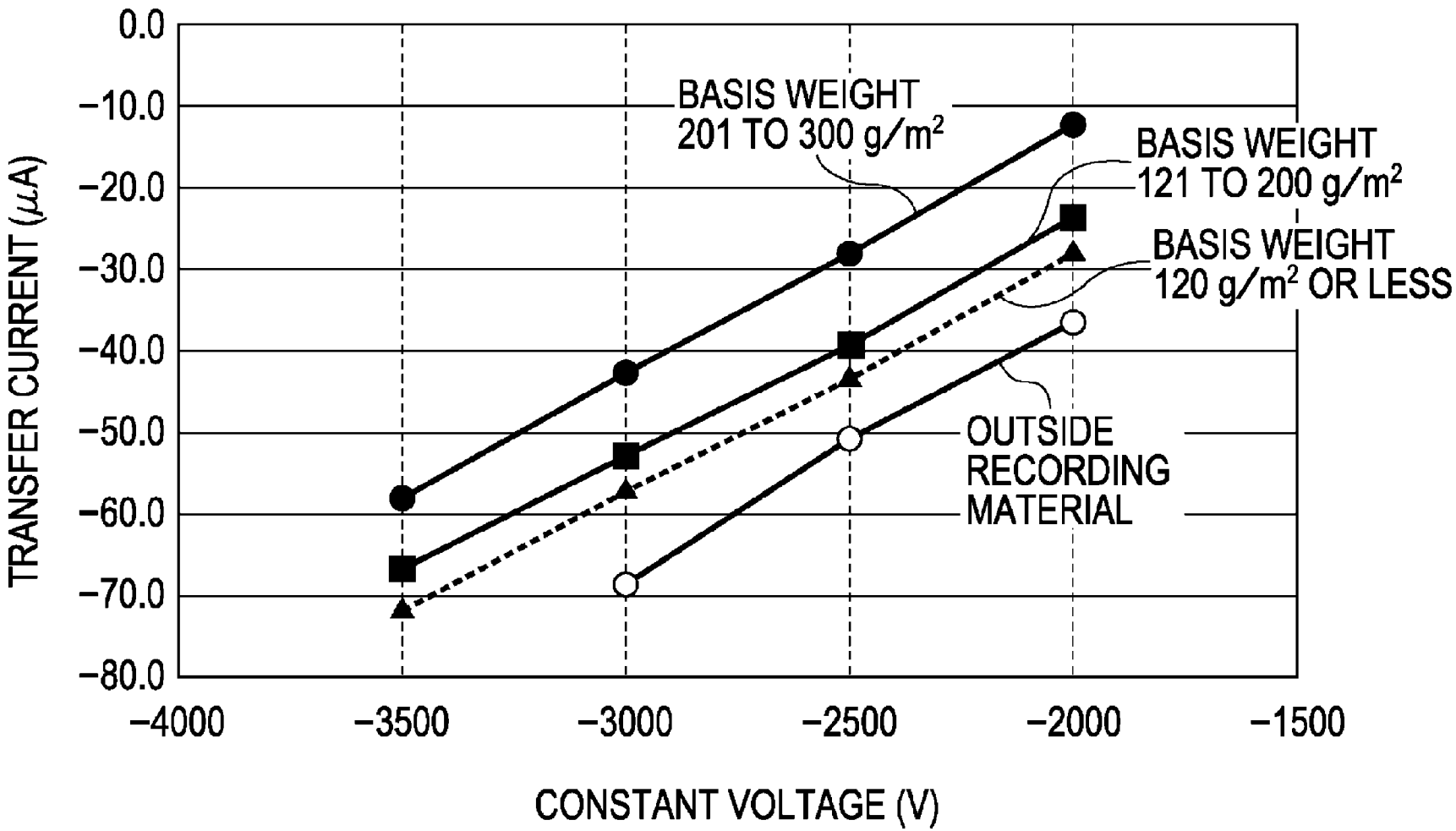
FIG. 12 is a graph showing a control operation performed to adjust a refresh time interval depending on the basis weight of the recording material.

FIG. 12 is a graph showing a control operation performed to adjust a refresh time interval depending on the basis weight of the recording material.

As shown in FIG. 12 with reference to FIG. 2, when secondary transfer is performed on recording materials P with different basis weights (g/m$^2$), the relationship between voltage applied to the secondary transfer roller 11 and transfer current flowing through the secondary transfer section T2 varies depending on the basis weight (g/m$^2$).

When the materials of two recording materials P are the same, a recording material P having a higher basis weight has a greater thickness and resistance value. Therefore, to produce the same transfer current as that for the other recording material P, the power source D2 outputs a higher constant voltage to the secondary transfer roller 11.

Moreover, since an increase in the basis weight of a recording material P means an increase in the amount of heat removed by the recording material P in the fixing device 25 (see FIG. 1), a larger amount of heat is required to fix a toner image transferred to the recording material P. Therefore, when the basis weight ($g/m^2$) of the recording material P increases, the image forming apparatus 100 increases a conveyance interval between adjacent recording materials P.

Thus, when a type of paper having a high basis weight ($g/m^2$) is selected, since a high constant voltage is set at the power source D2, the total amount of discharge products produced at the secondary transfer section T2 increases.

Additionally, when a conveyance interval (inter-sheet gap) between adjacent recording materials P is increased, if the supply toner images DY, DM, and DC are formed once every predetermined number of sheets, a corresponding refresh time ("OPERATING TIME" to the curve in the graph shown in FIG. 9) may be exceeded.

To prevent this, in Example 4, when image formation is performed in the black monochrome mode on postcard-size recording materials P having a high basis weight ($g/m^2$), the supply toner images DY, DM, and DC illustrated in FIG. 7 are formed at intervals smaller than those in Example 3 in terms of the number of sheets.

Table 1 shows, for each of recording materials P having different basis weights ($g/m^2$), a constant voltage applied to the secondary transfer roller 11, a transfer current flowing outside the width of the recording material P, and an interval of formation of the supply toner images DY, DM, and DC in Example 4.

TABLE 1

| Basis Weight ($g/m^2$) | Copies Produced per Minute | Constant Voltage (V) at 40 μA | Outside Transfer Current (μA) | Interval of Supply Toner Image Formation | I × t |
|---|---|---|---|---|---|
| 120 or less | 60 | 2400 | 45 | 100 sheets | 75 |
| 121-200 | 45 | 2500 | 50 | 75 sheets | 83.3 |
| 201-300 | 20 | 2900 | 67 | 25 sheets | 83.3 |

FIG. 12 shows, with respect to each of the recording materials P with different basis weights, a relationship between constant voltage applied to the secondary transfer roller 11 and transfer current flowing inside or outside the width of the recording material P.

On the basis of the transfer current flowing when no recording material P is present ("OUTSIDE RECORDING MATERIAL" in FIG. 12) and a corresponding refresh time ("OPERATING TIME" to the curve in the graph shown in FIG. 9), the number of sheets on which image formation is performed until formation of the supply toner images DY, DM, and DC is set for each type of the recording materials P as shown in Table 1.

Thus, even when the recording material P having any basis weight ($g/m^2$) is used, Expression 1 above can be satisfied by forming the supply toner images DY, DM, and DC at intervals described in Example 4. After image formation is performed in the black monochrome mode on postcard-size recording materials P having a high basis weight, even if image formation is performed on A4-size recording materials P in the full-color mode, backside contamination caused by the yellow color patch CY does not occur on the recording materials P.

Example 5

In Examples 2 to 4, the frequency of formation of the supply toner images DY, DM, and DC is reduced to save black toner. In contrast, in Example 5, the amount of toner consumption is reduced to save black toner.

In the control performed in step S13 of FIG. 8, the control unit 110 adjusts exposure conditions of the supply toner images DY, DM, and DC to lower the density of the supply toner images DY, DM, and DC to a value (e.g., 40/256) lower than that of the color patches CY, CM, and CK. By lowering the density of the supply toner images DY, DM, and DC and increasing the frequency of formation thereof, it is possible to reliably prevent in the black monochrome mode a cleaning failure caused by the supply toner images DY, DM, and DC, without increasing the amount of toner consumption.

Second Exemplary Embodiment

Figure 13:
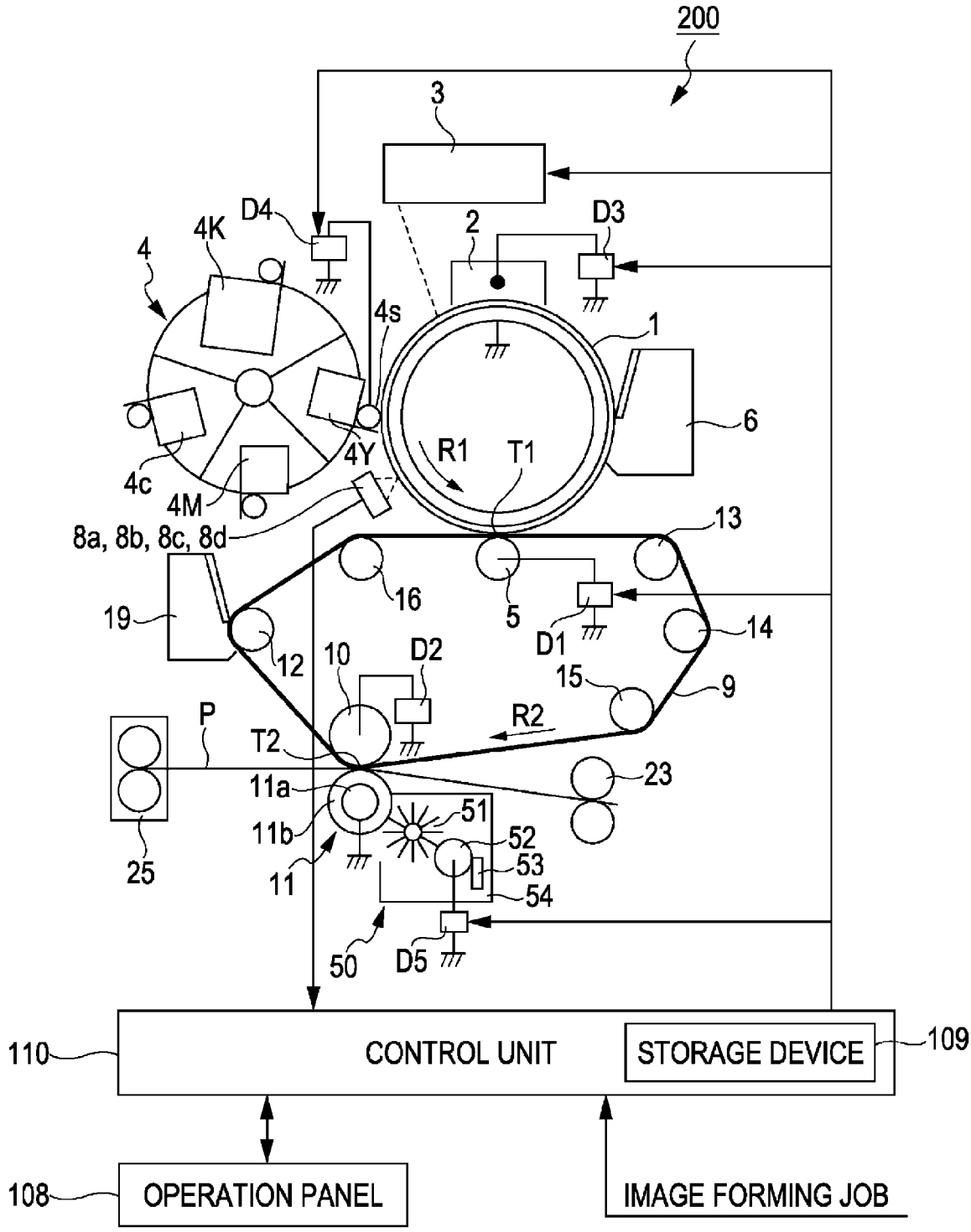
FIG. 13 illustrates a configuration of an image forming apparatus according to a second exemplary embodiment of the present invention.
Figure 14:
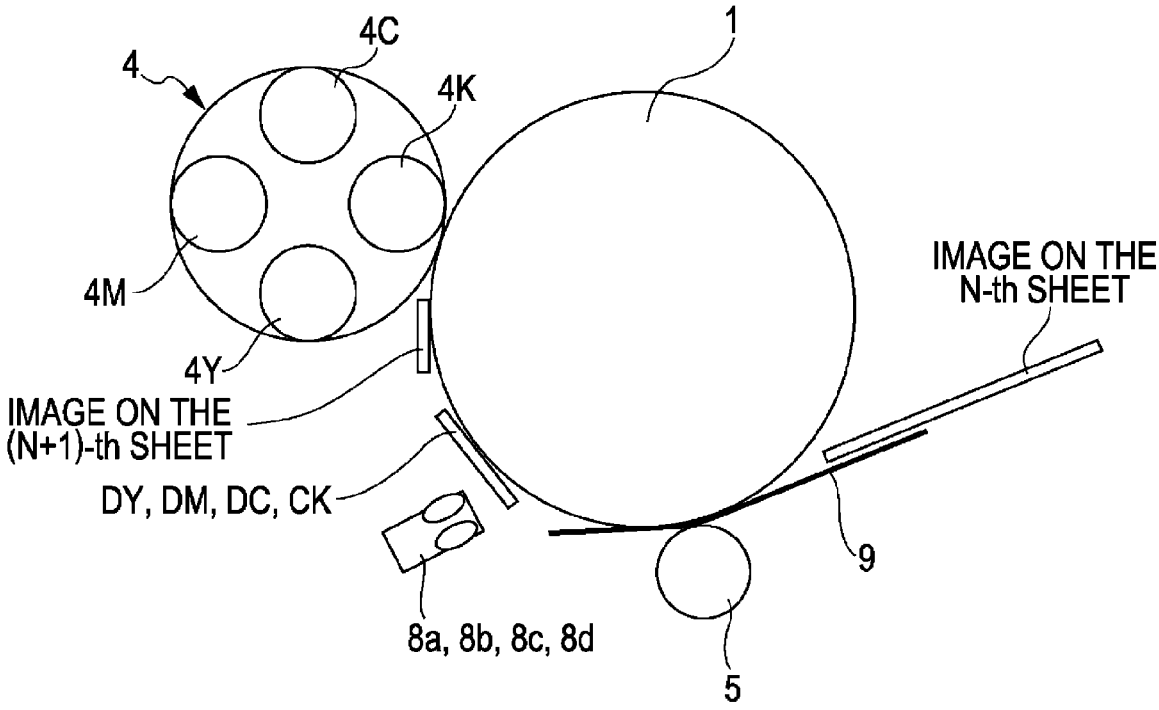
FIG. 14 illustrates formation of supply toner images.

FIG. 13 illustrates an image forming apparatus according to a second exemplary embodiment of the present invention. FIG. 14 illustrates formation of supply toner images.

An image forming apparatus 200 of the second exemplary embodiment is configured and controlled in a manner similar to that for the image forming apparatus 100 of the first exemplary embodiment, except that the image forming apparatus 200 includes a rotary developing device 4 and forms toner images of a plurality of colors on a single photoconductive drum 1. Distinct features of the second exemplary embodiment are delineated below. In FIG. 13 and FIG. 14, components common to those in FIG. 1 and FIG. 2 are given the same reference numerals.

As illustrated in FIG. 13, when the full-color mode is set, the image forming apparatus 200 develops an electrostatic image formed on the photoconductive drum 1 with toner of yellow, magenta, cyan, and black and sequentially forms toner images of theses colors. In the primary transfer section T1, the toner images of theses colors formed on the photoconductive drum 1 are superimposed in order of formation and primary-transferred onto the intermediate transfer belt 9.

After completion of the primary transfer onto the intermediate transfer belt 9, the resulting four-color toner image carried by the intermediate transfer belt 9 is conveyed to the secondary transfer section T2 and secondary-transferred onto the recording material P. The recording material P onto which the four-color toner image has been secondary-transferred is subjected to heat and pressure by the fixing device 25. Thus, the toner image is fixed to the surface of the recording material P.

As illustrated in FIG. 13, a charging device 2, an exposure device 3, the developing device 4, a primary transfer roller 5, and a cleaning device 6 are disposed around the photoconductive drum 1 that is rotatable.

The photoconductive drum 1 is obtained by forming a negatively-charged photosensitive layer on the outer surface of an aluminum cylinder connected to the ground potential. The photoconductive drum 1 is rotated in the direction of arrow R1 by a driving force transmitted to an end in the axial direction thereof.

The charging device 2 irradiates the photoconductive drum 1 with charged particles generated by application of a voltage from the power source D3, thereby uniformly and negatively charging the surface of the photoconductive drum 1.

The exposure device 3 uses a rotating mirror to scan the surface of the photoconductive drum 1 with a laser beam produced by ON-OFF modulating scanning line data obtained by expanding image data. Thus, the exposure device 3 writes an electrostatic image onto the surface of the photoconductive drum 1.

The entire developing device 4 can rotate to move each of a yellow developing unit 4Y, a magenta developing unit 4M, a cyan developing unit 4C, and a black developing unit 4K to a position facing the photoconductive drum 1. The yellow developing unit 4Y, magenta developing unit 4M, cyan developing unit 4C, and black developing unit 4K use yellow toner, magenta toner, cyan toner, and black toner, respectively, to form toner images of the respective colors. The yellow developing unit 4Y is described in detail. The developing units of other toners are the same except for color.

The yellow developing unit 4Y causes the developing sleeve 4*s* to carry a thin layer of negatively-charged yellow toner and to rotate in the direction opposite the rotation of the photoconductive drum 1, with a small gap left between the developing sleeve 4*s* and the photoconductive drum 1.

The power source D4 applies, to the developing sleeve 4*s*, a developing voltage obtained by superimposing an alternating voltage on a negative direct voltage. This causes the toner on the developing sleeve 4*s* to move to an exposed portion of the photoconductive drum 1, thereby forming a toner image obtained by reverse-developing an electrostatic latent image.

At a midpoint between the developing device 4 and the primary transfer section T1, the photodetectors 8*a*, 8*b*, 8*c*, and 8*d* irradiate color patches carried by the photoconductive drum 1 with infrared light, and outputs to the control unit 110 an analog voltage corresponding to the amount of diffuse reflected light.

The photodetectors 8*a*, 8*b*, 8*c*, and 8*d* are spaced apart in the axial direction of the photoconductive drum 1, similar to those of the first exemplary embodiment (see FIG. 3).

The primary transfer roller 5 is pressed into contact with the photoconductive drum 1 with the intermediate transfer belt 9 interposed therebetween. Thus, the primary transfer section T1 is formed between the photoconductive drum 1 and the intermediate transfer belt 9.

The power source D1 applies a positive direct voltage to the primary transfer roller 5. This causes a negative toner image carried by the photoconductive drum 1 to be transferred to the intermediate transfer belt 9.

Toner that has passed through the primary transfer section T1 and remains untransferred on the photoconductive drum 1 is scraped off by the cleaning device 6.

The intermediate transfer belt 9 serving as an image bearing member is supported by the tension roller 12, driving roller 13, backup roller 10, and support rollers 14, 15, and 16 and runs at a processing speed of 300 mm/second in the direction of arrow R2.

The secondary transfer roller 11 serving as a transfer member is pressed into contact with the backup roller 10 with the intermediate transfer belt 9 interposed therebetween. Thus, the secondary transfer section T2 is formed between the intermediate transfer belt 9 and the secondary transfer roller 11.

The secondary transfer roller 11 is connected to the ground potential, while the backup roller 10 is connected to the power source D2.

The power source D2 applies a negative direct voltage to the backup roller 10. Thus, a negative toner image carried by the intermediate transfer belt 9 is pushed out and secondary-transferred to the recording material P that passes through the secondary transfer section T2.

The registration rollers 23 temporarily hold the recording material P fed from a feed cassette (not shown), and send the recording material P to the secondary transfer section T2 simultaneously with the conveyance of the toner image on the intermediate transfer belt 9 to the secondary transfer section T2.

Toner that has passed through the secondary transfer section T2 and remains untransferred on the intermediate transfer belt 9 is scraped off by the cleaning device 19.

The secondary transfer roller 11 and the cleaning device 19 are arranged such that they can be brought into contact with or can be separated from the intermediate transfer belt 9. During the process of superimposing toner images of the four colors onto the intermediate transfer belt 9 to cause the intermediate transfer belt 9 to carry the toner images thereon, the secondary transfer roller 11 and the cleaning device 19 are separated from the intermediate transfer belt 9 such that they do not come into contact with the toner images. After the toner image of the third color passes through respective points of contact with the intermediate transfer belt 9, the secondary transfer roller 11 and the cleaning device 19 come into contact with the intermediate transfer belt 9 to prepare for the secondary transfer.

When the full-color mode is set, the control unit 110 sequentially forms the color patches CY, CM, CC, and CK, serving as control toner images in a space between adjacent toner images formed on the photoconductive drum 1.

The color patches CY, CM, CC, and CK having a square shape of 25 mm by 25 mm are displaced from each other in the axial direction of the photoconductive drum 1 (see FIG. 3).

The secondary-transfer-roller cleaning device 50 has a cleaning capability to substantially completely remove, by single passage, the color patches CY, CM, CC, and CK transferred to the secondary transfer roller 11 in a conveyance interval between adjacent recording materials P.

The secondary-transfer-roller cleaning device 50 allows the fur brush 51 serving as a conductive brush member to be in contact with a portion of the surface of the secondary transfer roller 11, the portion being located downstream of the secondary transfer section T2.

During rotation of the secondary transfer roller 11, the power source D5 continues applying a positive voltage to the metal roller 52 so as to cause a cleaning current to flow through a series circuit including the secondary transfer roller 11, the fur brush 51, and the metal roller 52. Thus, toner particles negatively charged and attached to the surface of the secondary transfer roller 11 are electrostatically moved to the fur brush 51, electrostatically moved further to the metal roller 52, and collected by the cleaning blade 53 into the waste container <Black Monochrome Mode>

The image forming apparatus 200 executes the black monochrome mode as well as the full-color mode described above. In the black monochrome mode, the rotary developing device 4 is locked and high-speed continuous image formation is performed on recording materials P at conveyance intervals (sheet intervals) that are one-quarter or less than those in the full-color mode. As a result, in the black monochrome mode, the fur brush 51 is not refreshed using the color patches CY, CM, and CC.

Thus, the control unit 110 uses the black developing unit 4K that can be used in the black monochrome mode to cause the supply toner images DY, DM, and DC corresponding to the color patches CY, CM, and CC, respectively, to be carried by the intermediate transfer belt 9 (see FIG. 7).

The control unit 110 controls the exposure device 3 serving as a toner-image forming unit to form, on the photoconductive drum 1, the supply toner images DY, DM, and DC that are intended for use in refreshing the fur brush 51 and are not used in adjusting toner-image forming conditions.

As illustrated in FIG. 14, according to the control performed in Example 1 described above, in a space between an image on the N-th sheet and an image on the (N+1)-th sheet, the supply toner images DY, DM, and DC and the color patch CK are formed in line in the axial direction.

Thus, during the period of the black monochrome mode, part of the fur brush 51 coming into contact with the color patches CY, CM, and CC is refreshed by the supply toner images DY, DM, and DC.

Therefore, when the black monochrome mode ends and the full-color mode is returned, since the color patches CY, CM, and CC transferred to the secondary transfer roller 11 can be sufficiently removed by single passage, there is no occurrence of backside contamination of the recording material P.

In the image forming apparatus 200 of the second exemplary embodiment, the amount of black toner consumption can be reduced by executing the control of Examples 2 to 4.

Third Exemplary Embodiment

The present invention can be implemented not only in full-color image forming apparatuses with an intermediate transfer belt, but also in image forming apparatuses with a recording-material conveying belt such as those described in Japanese Patent Laid-Open Nos. 6-149057, 2001-318539, 2007-079069, and 2007-78937. Additionally, the present invention can be implemented in the case where toner images of different colors are transferred to a recording material carried by a recording-material conveying belt, control toner images formed in a space between toner images are transferred to the recording-material conveying belt, and the control toner images are removed by an electrostatic cleaning device attached to the recording-material conveying belt.

In the black monochrome mode, by forming non-control toner images using black toner at positions corresponding to respective positions of control toner images of other colors, a fur brush for cleaning the recording-material conveying belt can be refreshed.

<Adjustment of Toner-image Forming Conditions>

Figure 15:
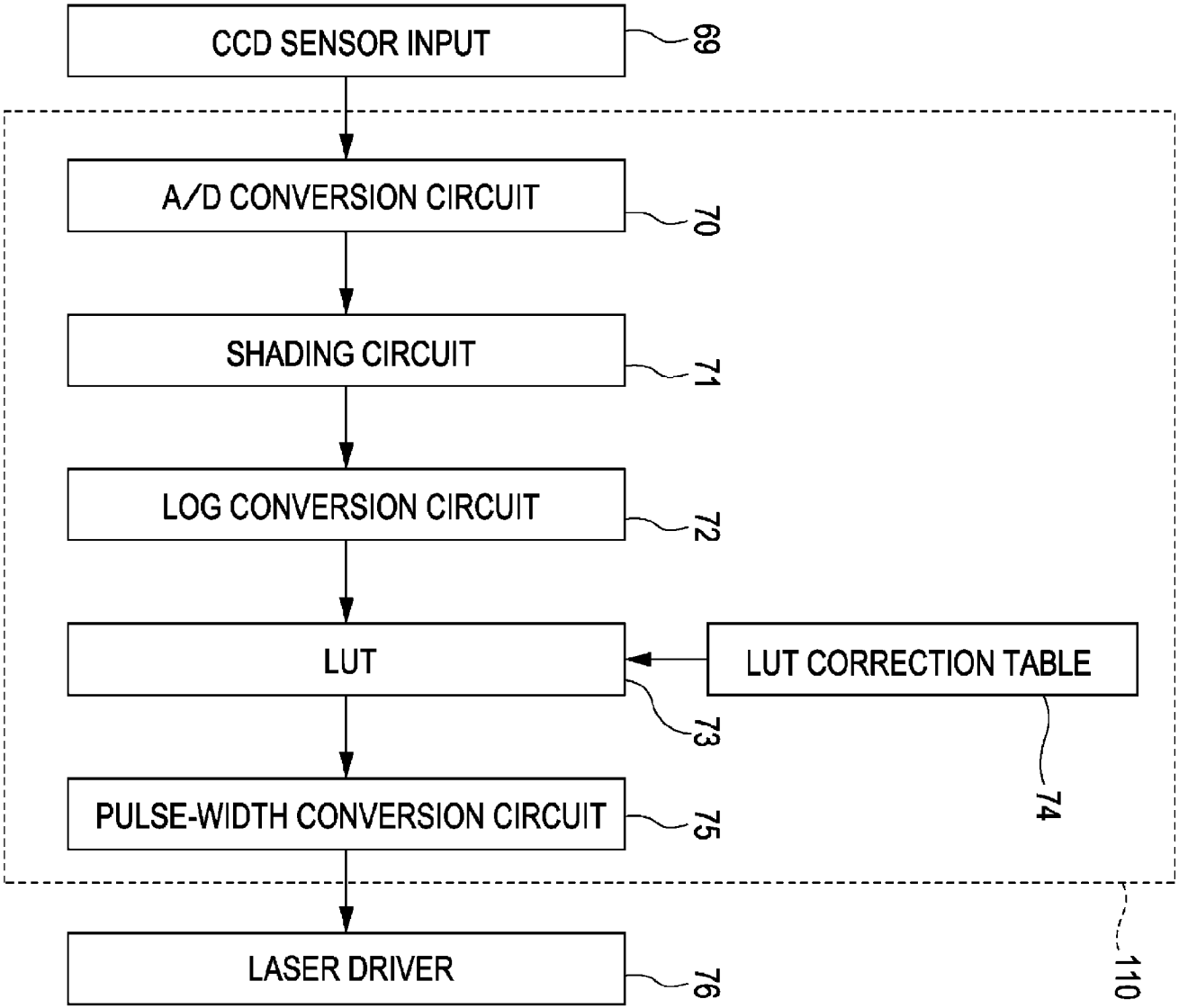
FIG. 15 is a block diagram illustrating a control operation for toner image formation.
Figure 16:
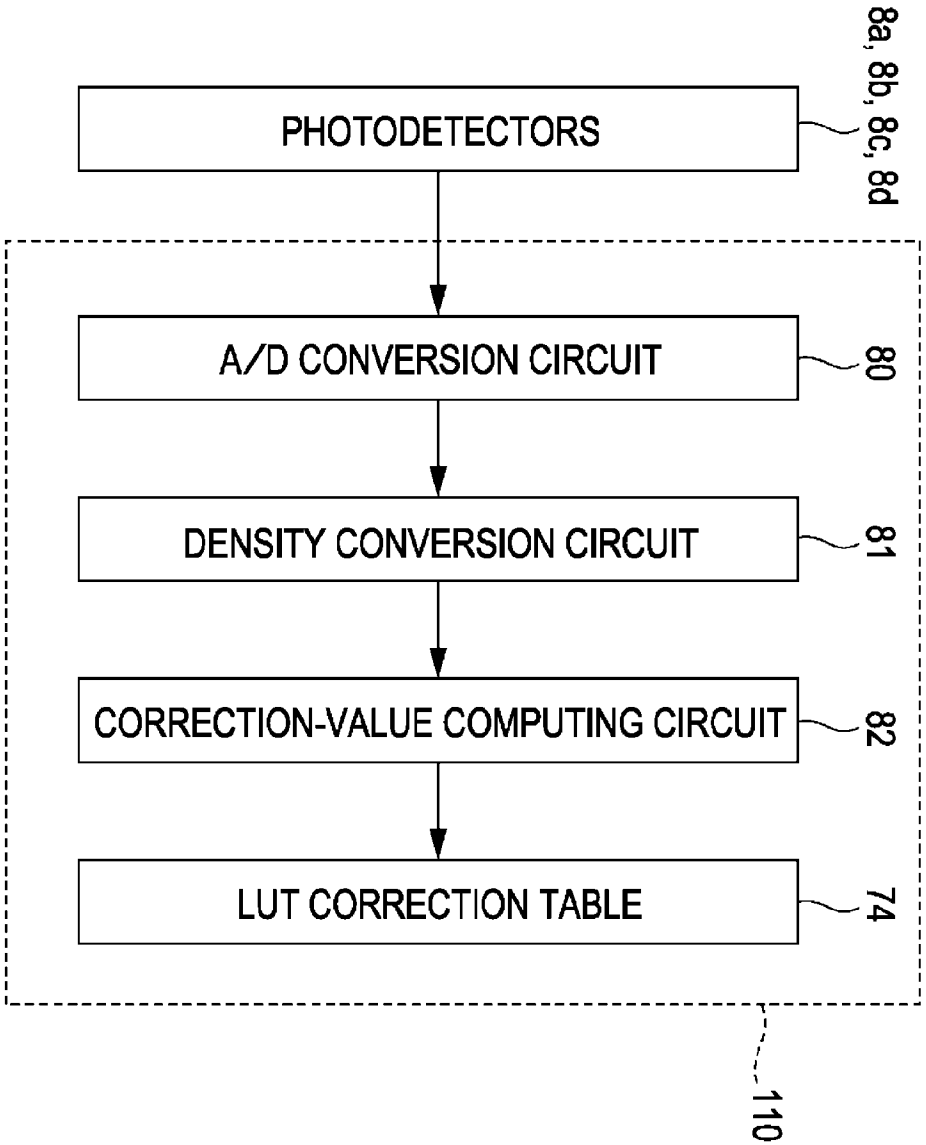
FIG. 16 is a block diagram illustrating a control operation for adjusting toner-image forming conditions.
Figure 17:
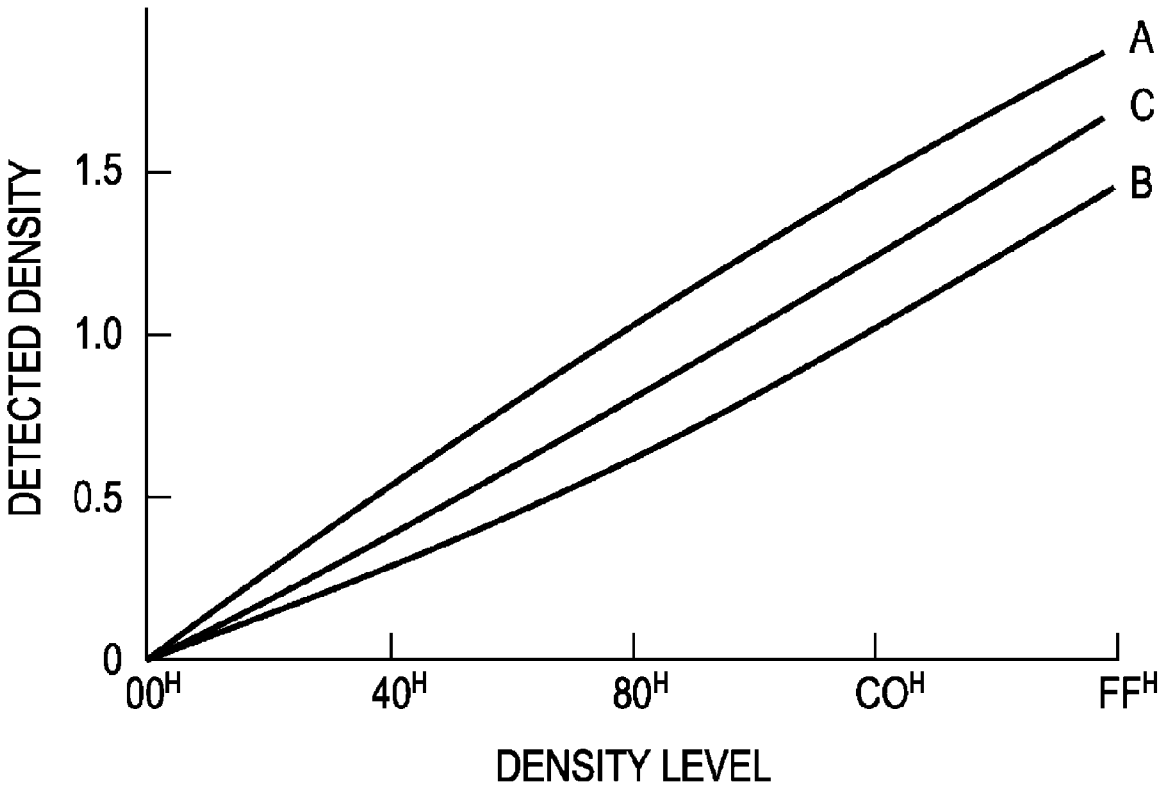
FIG. 17 is a graph showing a relationship between a density of an image after being fixed and a toner-image forming condition.
Figure 18:
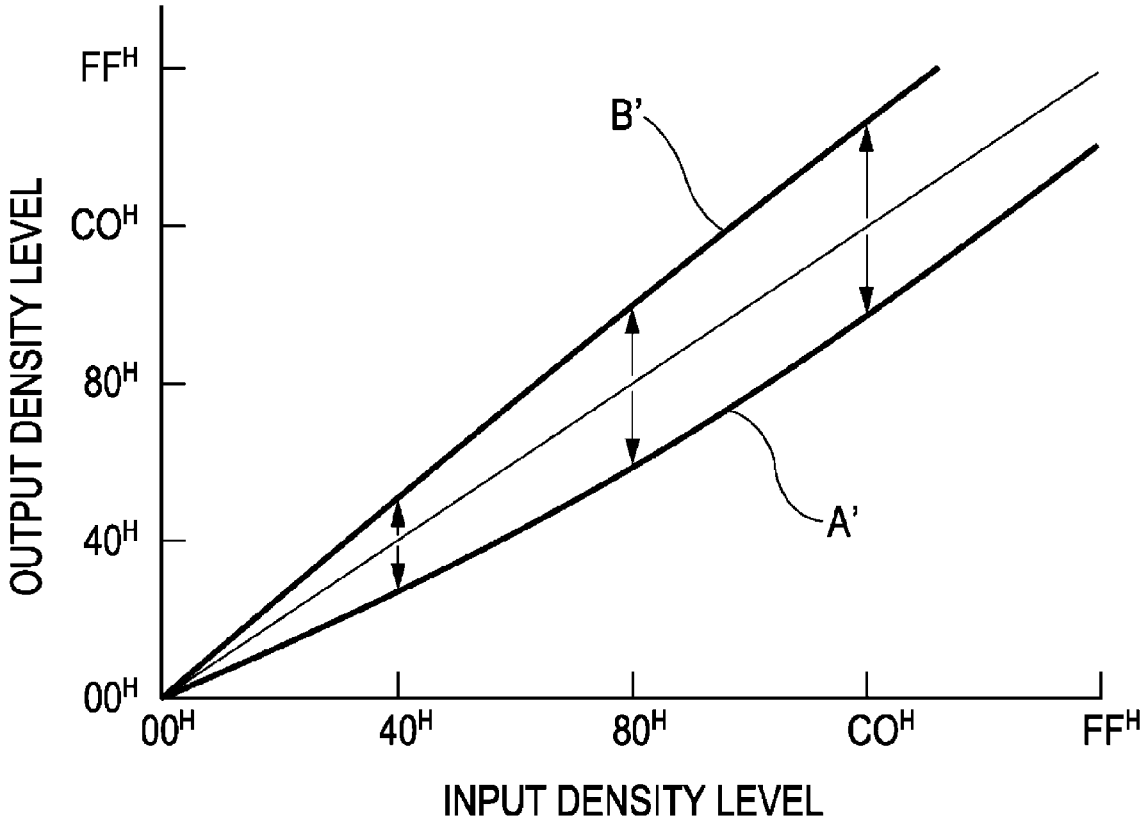
FIG. 18 is a graph showing a control operation for adjusting toner-image forming conditions.

FIG. 15 is a block diagram illustrating a control operation for toner image formation. FIG. 16 is a block diagram illustrating a control operation for adjusting toner-image forming conditions. FIG. 17 is a graph showing a relationship between the density of an image after being fixed and a toner-image forming condition. FIG. 18 is a graph showing a control operation for adjusting toner-image forming conditions.

During continuous image formation, the image forming apparatus 100 of the first exemplary embodiment forms control toner images for adjusting the density gradation of toner images in a space between a toner image on the N-th sheet and a toner image on the (N+1)-th sheet.

A luminance signal of an image to be formed can be obtained at a charge-coupled-device (CCD) sensor input 69 of an image scanning unit. The obtained luminance signal is converted to a digital luminance signal by an analog-to-digital (A/D) conversion circuit 70.

The digital luminance signal passes through a shading circuit 71, where variations in sensitivity among individual CCD sensor elements of the image scanning unit are corrected.

A LOG conversion circuit 72 converts the shading-corrected luminance signal to a density signal. The density signal obtained by the LOG conversion circuit 72 is converted by a look-up table (LUT) 73 and corrected such that the relationship between the density of a scanned image and that of an output image matches γ characteristics of a printer with default settings.

The LUT 73 is corrected by a LUT correction table 74 formed according to the results of computation described below.

The density signal converted by the LUT 73 is converted by a pulse-width conversion circuit 75 to a pulse width modulation (PWM) signal generated by converting a density gradation to a dot width. Then, the PWM signal is sent to a laser driver 76.

Thus, by scanning the surface of a photoconductive drum with laser light using an exposure signal subjected to digital signal processing, an electrostatic image having gradation characteristics represented by variations in dot area is formed on the photoconductive drum.

The image forming apparatus 100 includes a test pattern generator that outputs four different levels of density signal onto the photoconductive drums 1*a*, 1*b*, 1*c*, and 1*d*. The density signal has 256 gradation levels represented by 8-bit data. Thus, control toner images to which four density levels, 40/256, 80/256, 120/256, and 256/256, are given by the test pattern generator are formed.

The four types of control toner images of four different colors each have a square shape of 25 mm by 25 mm and are sequentially formed on the photoconductive drums 1*a*, 1*b*, 1*c*, and 1*d* in the axial direction in every carrying interval between adjacent toner images.

At positions upstream of the primary transfer sections T1, the photodetectors 8*a*, 8*b*, 8*c*, and 8*d* detect, from the control toner images formed on the photoconductive drums 1*a*, 1*b*, 1*c*, and 1*d*, the outputs of reflected light corresponding to optical densities of the respective control toner images (see FIG. 4).

As illustrated in FIG. 16, analog signals output by the photodetectors 8*a*, 8*b*, 8*c*, and 8*d* are converted by an A/D conversion circuit 80 to digital signals and further converted by a density conversion circuit 81 to density signals.

As shown in FIG. 17, in default settings in the LUT 73 of FIG. 15, densities corresponding to density levels of the respective control toner images are set to be represented by curve C.

However, the sensitivity and developing characteristics of the photoconductive drums 1*a*, 1*b*, 1*c*, and 1*d* vary with changes in toner supply mode, changes in ambient temperature and humidity, time, and the like. Therefore, the detected densities corresponding to the density levels are represented by curve A or curve B, which deviates from curve C representing the default settings.

Thus, if densities detected by the photodetectors 8*a*, 8*b*, 8*c*, and 8*d* are higher than set values as indicated by curve A, PWM signals and other toner-image forming conditions are corrected such that the detected densities are lowered from the set values, as indicated by curve A' of FIG. 18, by an amount greater than the set values.

On the other hand, if densities detected by the photodetectors 8*a*, 8*b*, 8*c*, and 8*d* are lower than set values as indicated by curve B, PWM signals and other toner-image forming conditions are corrected such that the detected densities are raised from the set values, as indicated by curve B' of FIG. 18, by an amount lower than the set values.

Therefore, as illustrated in FIG. 16, after the density conversion circuit 81 calculates densities and the correction-value computing circuit 82 performs computation for determining correction values, the LUT correction table 74 for correcting the LUT 73 is created.

By correcting the LUT 73 with the LUT correction table 74 created as described above, variations in printer gradation characteristics are corrected and constant printer gradation characteristics can be achieved.

By performing such correction for each color, a full-color image with excellent color balance can be obtained. The correction values are stored in the storage device 109 of the control unit 110, and when it is determined that the gradation characteristics are abnormal, the correction values are used until the above-described correction is made.

The control toner images are not limited to the color patches described above, but may be so-called registration marks for positioning toner images of respective colors.

In the exemplary embodiments described above, control toner images formed on the photoconductive drum are detected. However, the configuration may be made such that control toner images formed on the photoconductive drum are transferred to the intermediate transfer member and detected and then, conditions of image formation are controlled.

As described above, according to the present invention, without excessive consumption of toner of one color that is currently used, part of the conductive brush member to be refreshed by control toner images of other colors can be refreshed.

Then, discharge products (e.g., nitrogen oxides) formed at the transfer unit, dragged by the transfer member, and attached to the conductive brush member can be removed from the surface of the conductive brush member by causing the discharge products to adhere to toner particles on the non-control toner images.

Therefore, without excessive toner consumption, it is possible to prevent, during the black monochrome mode, degradation in cleaning capability of part of the conductive brush member that should perform cleaning of the control toner images of other colors. Thus, it is possible to realize an image forming apparatus in which, even if the black monochrome mode continues for a long period of time, the cleaning capability necessary for the electrostatic cleaning device for the transfer member can be ensured, and when the full-color mode is returned, backside contamination does not occur in the recording material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2007-175971 filed Jul. 4, 2007, which is hereby incorporated by reference herein in its entirety.

What is claimed is:

1. An image forming apparatus comprising:

a belt member;

a first image forming unit and a second image forming unit that are configured to form toner images on the belt member;

a transfer member that is rotatable and is configured to press the belt member to transfer toner images from the belt member onto a recording material;

a brush member configured to come into contact with the transfer member to remove toner from the transfer member; and a controller configured to control image forming conditions of at least one of the first and second image forming units;

the controller is capable of executing a first image forming mode wherein the first image forming unit and the second image forming unit form respective toner images on the belt member, the first image forming unit transfers a control toner image to a first region of the belt member, and the second image forming unit transfers another control toner image to a second region of the belt member, the first region displaced from the second region in a rotational axis direction of the transfer member; and the controller is capable of executing a second image forming mode wherein the first image forming unit does not form toner images on the belt member and the second image forming unit forms toner images on the belt member, and responsive to the second image forming unit forming a control toner image, toner images are disposed on both the first and second regions of the belt member, and one of the toner images is the control toner image.

2. The image forming apparatus according to claim 1, wherein a length of each toner image in the rotational axis direction when the second image forming unit forms a control toner image in the second image forming mode is substantially the same as a length of each control toner image in the rotational axis direction in the first image forming mode.

3. The image forming apparatus according to claim 1, wherein, when the second image forming unit forms a control toner image in the second image forming mode, one toner image is a control toner image and another toner image is a non-control toner image not involved in control of image forming conditions of the second image forming unit.

4. The image forming apparatus according to claim 3, wherein the amount of toner loaded on the non-control toner image is smaller than the amount of toner loaded on the control toner image.

5. The image forming apparatus according to claim 3, wherein the frequency of formation of the non-control toner image is lower than the frequency of formation of the control toner image.

6. The image forming apparatus according to claim 1, further comprising detecting members, each being configured to detect a control toner image transferred to the belt member.

7. The image forming apparatus according to claim 1, wherein the first image forming unit and the second image forming unit each include an image bearing member; and a detecting member configured to detect a control toner image formed on the image bearing member is disposed opposite the image bearing member.

8. The image forming apparatus according to claim 3, wherein during a continuous transfer operation in which a voltage for transferring a toner image from the belt member onto a recording material is high, at least one of the frequency of causing the non-control toner image to be carried and the amount of toner loaded on the non-control toner image is increased.

9. The image forming apparatus according to claim 3, wherein, when the non-control toner image is located in an external region outside a recording material in the rotational axis direction, at least one of the frequency of causing the non-control toner image to be carried and the amount of toner loaded on the non-control toner image is made higher than that in the case where the non-control toner image is not located in the external region.

10. The image forming apparatus according to claim 1, wherein the first image forming unit and the second image forming unit each include an image bearing member; and in the second image forming mode, the image bearing member of the first image forming unit is separated from the belt member.

11. An image forming apparatus comprising:

an image bearing member;

a first developing device and a second developing device that are configured to form toner images on the image bearing member;

a belt member to which toner images formed on the image bearing member are transferred;

a transfer member that is rotatable and is configured to press the belt member to transfer toner images from the belt member onto a recording material;

a brush member configured to come into contact with the transfer member to remove toner from the transfer member; and a controller configured to control image forming conditions of the first and second developing devices;

the controller is capable of executing a first image forming mode wherein the first developing device and the second developing device form respective toner images on the belt member, the first developing device transfers a control toner image to a first region of the belt member, and the second developing device transfers another control toner image to a second region of the belt member, the first region displaced from the second region in a rotational axis direction of the transfer member; and the controller having a second image forming mode wherein the first developing device does not form toner images on the belt member and the second developing device forms toner images on the belt member, and responsive to the second developing device forming a control toner image, toner images are disposed on both the first and second regions of the belt member, and one of the toner images is the control toner image.

12. The image forming apparatus according to claim 11, wherein a length of each toner image in the rotational axis direction when the second developing device forms a control toner image in the second image forming mode is the same as a length of each control toner image in the rotational axis direction in the first image forming mode.

13. The image forming apparatus according to claim 11, wherein, when the second developing device forms a control toner image in the second image forming mode, one toner image is a control toner image and another toner image is a non-control toner image not involved in control of image forming conditions of the second developing device.

14. The image forming apparatus according to claim 13, wherein the amount of toner loaded on the non-control toner image is smaller than the amount of toner loaded on the control toner image.

15. The image forming apparatus according to claim 13, wherein the frequency of causing the non-control toner image to be carried is lower than the frequency of causing the control toner image to be carried.

16. The image forming apparatus according to claim 11, further comprising a detecting member configured to detect a control toner image transferred to the belt member.

17. The image forming apparatus according to claim 11, further comprising a detecting member configured to detect a control toner image formed on the image bearing member.

18. The image forming apparatus according to claim 13, wherein during a continuous transfer operation in which a voltage for transferring a toner image from the belt member onto a recording material is high, at least one of the frequency of causing the non-control toner image to be carried and the amount of toner loaded on the non-control toner image is increased.

19. The image forming apparatus according to claim 13, wherein, when the non-control toner image is located in an external region outside a recording material in the rotational axis direction, at least one of the frequency of causing the non-control toner image to be carried and the amount of toner loaded on the non-control toner image is made higher than that in the case where the non-control toner image is not located in the external region.

* * * * *